US012312901B2

(12) United States Patent
Vasques

(10) Patent No.: US 12,312,901 B2
(45) Date of Patent: May 27, 2025

(54) DOWNHOLE EXPANDABLE TUBULAR

(71) Applicant: Welltec Manufacturing Center Completions ApS, Esbjerg N (DK)

(72) Inventor: Ricardo Reves Vasques, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 17/983,701

(22) Filed: Nov. 9, 2022

(65) Prior Publication Data

US 2023/0147260 A1 May 11, 2023

(30) Foreign Application Priority Data

Nov. 10, 2021 (EP) ..... 21207644
Jun. 3, 2022 (EP) ..... 22177326

(51) Int. Cl.
*E21B 33/12* (2006.01)
*E21B 33/13* (2006.01)
*E21B 43/10* (2006.01)

(52) U.S. Cl.
CPC ..... *E21B 33/1212* (2013.01); *E21B 33/13* (2013.01); *E21B 43/103* (2013.01)

(58) Field of Classification Search
CPC .... E21B 43/103; E21B 33/13; E21B 33/1208; E21B 33/1212; E21B 33/127; E21B 29/10
See application file for complete search history.

(56) References Cited

U.S. PATENT DOCUMENTS

2004/0149418 A1 8/2004 Bosma et al.
2016/0348463 A1* 12/2016 Vasques ..... E21B 33/1277
2017/0101846 A1* 4/2017 Vasques ..... E21B 33/128
2021/0189830 A1* 6/2021 Greci ..... E21B 43/103
2021/0189842 A1 6/2021 Greci et al.
2022/0341280 A1* 10/2022 Holderman ..... E21B 33/1208
2022/0381106 A1* 12/2022 Greci ..... E21B 33/13

FOREIGN PATENT DOCUMENTS

EP 2 599 956 A1 6/2013
EP 2 789 792 10/2014
WO 2016/189020 12/2016
WO WO 2020/145938 A1 7/2020
WO 2021/021203 2/2021

OTHER PUBLICATIONS

Extended European Search Report for EP Application No. 21207644.2 dated Mar. 21, 2022, 10 pages.
International Search Report and Written Opinion mailed Feb. 1, 2023 in International Application No. PCT/EP2022/081333, 16 pages.

* cited by examiner

*Primary Examiner* — Yong-Suk (Philip) Ro
(74) *Attorney, Agent, or Firm* — Nixon & Vanderhye P.C.

(57) ABSTRACT

A downhole expandable tubular for expansion in a well downhole to abut against an inner face of a well tubular metal structure or borehole, includes at least first and second circumferential edges on the outer face, forming a circumferential groove, a sealing unit arranged in the circumferential groove. The sealing unit includes a post-transition metal material, the sealing unit has an annular sealing element and a retaining element, and at least the retaining element comprises the post-transition metal material, and the annular sealing element is made of elastomer, natural or synthetic rubber, or a polymer.

20 Claims, 14 Drawing Sheets

DOWNHOLE EXPANDABLE TUBULAR

CROSS-REFERENCE TO RELATED APPLICATIONS

Figure 1:
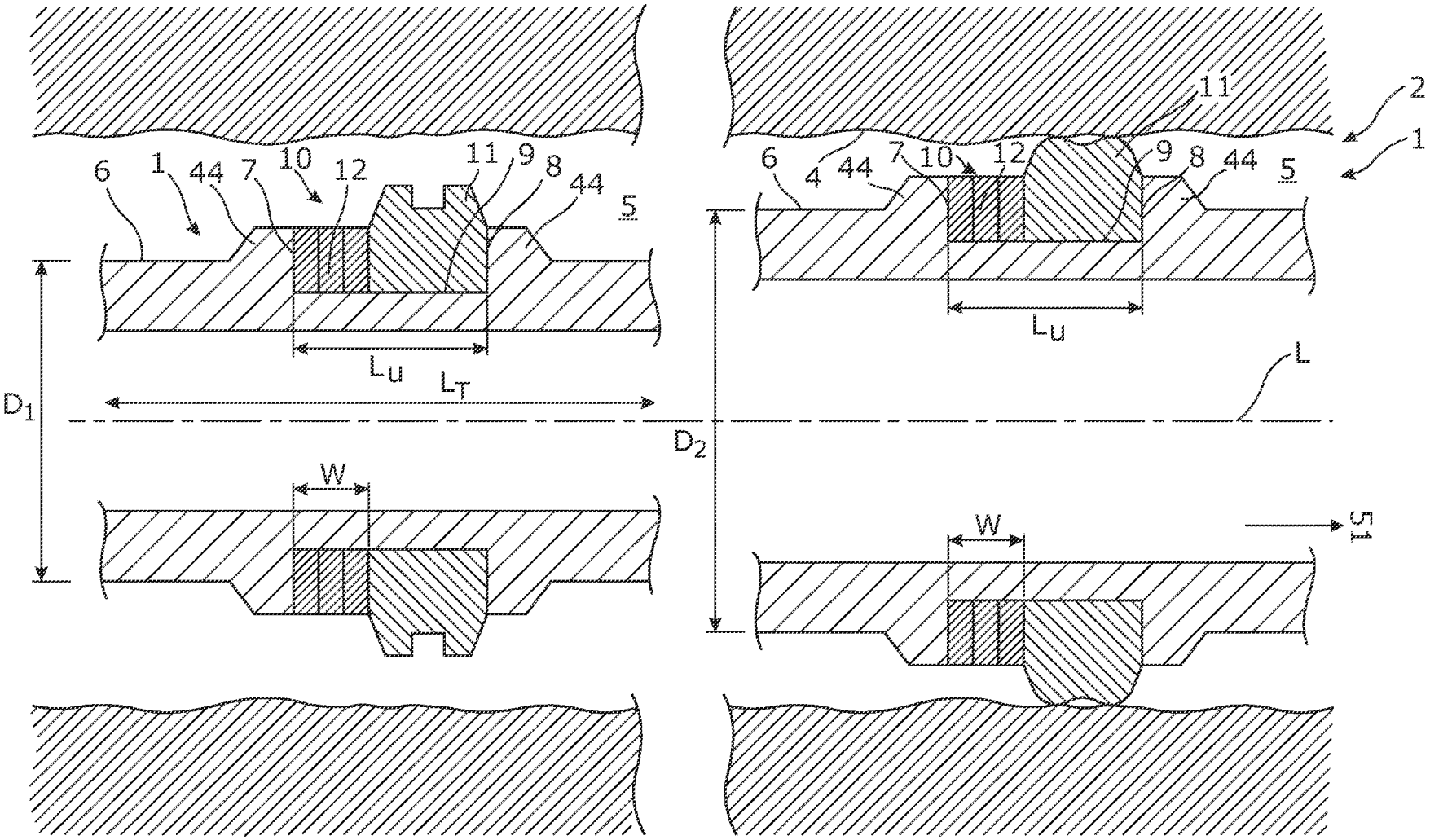

This application claims priority to EP patent application Ser. No. 21/207,644.2 filed Nov. 10, 2021, and EP patent application Ser. No. 22/177,326.0 filed Jun. 3, 2022, the entire contents of which are hereby incorporated by reference.

The present invention relates to a downhole expandable tubular for expansion in a well downhole from a first outer diameter to a second outer diameter to abut against an inner face of a well tubular metal structure or borehole, the downhole expandable tubular having an outer face, a longitudinal extension and a tubular length along the longitudinal extension. The invention also relates to an annular barrier for expansion in an annulus between a well tubular metal structure and an inner face of a borehole or another well tubular metal structure for providing zone isolation between a first zone and a second zone of the borehole. Moreover, the invention relates to a downhole system comprising a well tubular metal structure having an inner face, an outer face, a downhole expandable tubular being connected to the inner face, and a downhole closure unit arranged on the outer face for permanently sealing off a control line controlling a well component of the well tubular metal structure prior to plug and abandonment of a well having a top. Finally, the invention relates to a method of permanently closing fluid communication in the downhole closure unit for permanently sealing off a control line prior to plug and abandonment of a well.

When using elastomer seals in components downhole, the seals cannot be used for safe plug and abandonment. Such elastomer seals are used in a variety of completion components, such as patches, liner hangers and annular barriers, e.g. packers, etc., and over a long period of time such elastomer seals may become leaky. These components are often set in place by expanding a vital metal part, and when expanding such metal parts of the components, it is very difficult to pull them out of the well in order to plug and abandon the well in a safe manner.

It is an object of the present invention to wholly or partly overcome the above disadvantages and drawbacks of the prior art. More specifically, it is an object to provide an improved sealing unit which can be used in a safe plug and abandonment operation.

It is another object of the present invention to provide an improved sealing unit which can be used firstly as a seal and subsequently as part of a safe plug and abandonment operation.

The above objects, together with numerous other objects, advantages and features, which will become evident from the below description, are accomplished by a solution in accordance with the present invention by a downhole expandable tubular for expansion in a well downhole from a first outer diameter to a second outer diameter to abut against an inner face of a well tubular metal structure or borehole, the downhole expandable tubular having an outer face, a longitudinal extension and a tubular length along the longitudinal extension, comprising:

- at least one first circumferential edge and at least one second circumferential edge spaced apart in the longitudinal extension and provided on the outer face, forming a circumferential groove, and

- a sealing unit arranged in the circumferential groove, wherein the sealing unit comprises a post-transition metal material.

By having a sealing unit comprising a post-transition metal material, the post-transition metal material may at a later stage be able to fill up any gap if needed by heating the post-transition metal material to melt and subsequently solidify at the gap needing to be filled. As sealing units tend become weaker over the years, such sealing unit can be said to have a second life as when the sealing unit becomes too weak, the post-transition metal material is heated and any gap is filled, and the sealing unit is able to function properly once again e.g. for plug and abandonment operations.

In one aspect, the sealing unit may have a unit length along the longitudinal extension being less than 90% of the tubular length.

In another aspect, the sealing unit may have a unit length along the longitudinal extension being less than 20% of the tubular length.

Also, the unit length along the longitudinal extension may be less than 10% of the tubular length, and preferably less than 5% of the tubular length.

Furthermore, the post-transition metal material may comprise bismuth or a bismuth alloy.

Further, the sealing unit may comprise at least one element.

Additionally, the sealing unit may comprise only one element.

In addition, the sealing unit may comprise more than one element, and at least one of the elements may comprise the post-transition metal material.

Moreover, the sealing unit may further comprise an annular sealing element and a retaining element, and at least the retaining element may comprise a post-transition metal material such as bismuth or a bismuth alloy.

Furthermore, the annular sealing element may be made of elastomer, natural or synthetic rubber, polymer or similar.

By having the annular sealing element of elastomer or similar material and a retaining element providing buck-up for the sealing element, the sealing unit is capable of providing a sufficient sealing ability as known and required in the oil & gas industry while the retaining element comprising a post-transition metal material may at a later stage be able to fill up any gap if needed by heating the retaining element to melt and subsequently solidify at the gap needing to be filled. Thus, by making the retaining element in post-transition metal material, such as bismuth or a bismuth alloy, the retaining element can be incorporated in a sealing unit and when needed later on during plug and abandonment, the retaining element can be transformed to form a permanent seal sufficient to plug and abandon the well.

Further, the element comprising a post-transition metal material such as bismuth or a bismuth alloy may be one monolithic whole.

Additionally, the retaining element may have a first end and a second end, and the first end may overlap the second end when seen along the longitudinal extension or along a circumference of the downhole expandable tubular.

Also, the circumferential groove may be formed between two projections.

Furthermore, the annular sealing unit may comprise an annular sealing element and a back-up sealing element abutting and supporting the annular sealing element.

In addition, the annular sealing unit may further comprise a second back-up sealing element arranged so that the annular sealing element is between the two back-up sealing elements when seen along the axial extension.

Moreover, the annular sealing unit may also comprise an anchoring element arranged in a second circumferential groove, the anchoring element comprising a first anchoring part at least partly overlapping a second anchoring part in a radial direction perpendicular to the axial extension so that an inner face of the first anchoring part at least partly abuts an outer face of the second anchoring part.

Further, the retaining element may be a split ring-shaped retaining element having more than one winding so that when the expandable tubular is expanded from the first outer diameter to the second outer diameter, the split ring-shaped retaining element partly unwinds.

Additionally, the split ring-shaped retaining element may unwind by less than one winding when the expandable tubular is expanded from the first outer diameter to the second outer diameter.

Also, the split ring-shaped retaining element may have more than one winding in the second outer diameter of the downhole expandable tubular.

Furthermore, the split ring-shaped retaining element may have a width in the longitudinal extension, the width being substantially the same in the first outer diameter and the second outer diameter of the downhole expandable tubular.

In addition, the split ring-shaped retaining element may have a plurality of windings.

Moreover, the downhole expandable tubular may have a first thickness between the first and second circumferential edges and a second thickness in adjacent areas, the first thickness being smaller than the second thickness.

Further, the downhole expandable tubular may have a first thickness between the first and second circumferential edges, and the sealing unit may have an extension radial to the longitudinal extension of the downhole expandable tubular being less than twice the first thickness, and preferably equal to or smaller than the first thickness.

Additionally, the material may expand upon solidification.

Furthermore, the material may liquify at above 130 degrees centigrade.

In addition, the retaining element may be arranged in an abutting manner to the sealing element.

Moreover, the retaining element and the sealing element may substantially fill a gap created between the first and second circumferential edges.

Further, the split ring-shaped retaining element may at least partly be made of a spring material.

Additionally, the split ring-shaped retaining element may be arranged on a first side of the sealing element, and a second split ring-shaped retaining element may be arranged on another side of the sealing element opposite the first side.

Also, the split ring-shaped retaining element may retain the sealing element in a position along the longitudinal extension of the downhole expandable tubular while expanding the split ring-shaped retaining element and the sealing element.

Furthermore, the ring-shaped retaining element may be a split ring.

In addition, the first and second circumferential edges may be extending in a radial extension in relation to the downhole expandable tubular, said radial extension being perpendicular to the longitudinal extension of the downhole expandable tubular.

Moreover, the back-up sealing element may be arranged between the split ring-shaped retaining element and the sealing element.

Further, the split ring-shaped retaining element and the back-up sealing element may be arranged in an abutting manner to the sealing element so that at least one of the split ring-shaped retaining element and the back-up sealing element abuts the sealing element.

Additionally, the back-up sealing element may be made of polytetrafluoroethylene (PTFE) or polymer.

Also, the sealing element may be made of elastomer, rubber, polytetrafluoroethylene (PTFE) or another polymer.

Furthermore, the downhole expandable tubular may be a patch to be expanded within a casing or well tubular metal structure in a well, a liner hanger to be at least partly expanded within a casing or well tubular metal structure in a well, or a casing to be at least partly expanded within another casing.

In addition, the invention relates to an annular barrier for expansion in an annulus between a well tubular metal structure and an inner face of a borehole or another well tubular metal structure for providing zone isolation between a first zone and a second zone of the borehole, comprising:

- a tubular metal part for mounting as part of the well tubular metal structure,
- a downhole expandable tubular surrounding the tubular metal part and having an outer face facing towards the inner face of the borehole or the well tubular metal structure, each end of the downhole expandable tubular being connected with the tubular metal part,
- a annular space between the downhole expandable tubular and the tubular metal part, and
- an expansion opening in the tubular metal part through which fluid may enter into the annular space in order to expand the downhole expandable tubular.

Moreover, the annular barrier may further comprise the downhole closure unit in the annular space for permanently sealing off a control line controlling a well component of a well tubular metal structure prior to plug and abandonment of a well having a top, comprising:

- a first element comprising a first opening, a second opening and fluid communication between the first opening and the second opening, the first opening being arranged closer to the top than the second opening, the first opening having a first connection to a first part of a tubular line, and the second opening having a second connection to a second part of the tubular line, wherein the first element has a first state in which the fluid communication is open and a second state in which the fluid communication is closed.

By having a downhole closure unit arranged in the expandable space of the annular barrier fluidly connecting the first part and the second part of the tubular line, a very simple way of fluidly disconnecting the tubular line passing therethrough is provided, and the annular barrier can therefore form part of plug and abandonment of the well as no leaks can occur across the annular barrier when the first element has changed from the first state to the second state.

Further, the invention relates to a downhole system comprising a well tubular metal structure having an inner face, an outer face, a downhole expandable tubular being connected to the inner face, and a downhole closure unit arranged on the outer face for permanently sealing off a control line controlling a well component of the well tubular metal structure prior to plug and abandonment of a well having a top, the downhole expandable tubular comprising:

- a first element comprising a first opening, a second opening and fluid communication between the first opening and the second opening, the first opening being arranged closer to the top than the second opening, the first opening having a first connection to a first part of a tubular line, and the second opening having a second connection to a second part of the tubular line, wherein the first element has a first state in which the fluid communication is open and a second state in which the fluid communication is closed.

Additionally, the downhole system may comprise a well tubular metal structure having an inner face, an outer face and an annular barrier.

By having a downhole closure unit fluidly connecting the first part and the second part of the tubular line, a very simple way of fluidly disconnecting the tubular line passing therethrough is provided, and the well can therefore easily proceed to the subsequent steps of plug and abandonment of the well as no leaks can occur across the control line when the first element has changed from the first state to the second state. The fluid communication can be closed in a simple manner, and the first part of the tubular line/control line can be pulled out of the well before plugging and abandoning the well by cement.

Also, in the second state, a distance between the first part and the second part of the tubular line may be created.

Furthermore, the fluid communication may be provided by a through-bore in the first element of the downhole closure unit from the first opening to the second opening.

In addition, the tubular line may not penetrate the first element of the downhole closure unit.

Moreover, the fluid communication may be a fluid channel.

Further, the first element of the downhole closure unit may be tubeless, meaning that the tubular line does not extend through the first element.

Additionally, the through-bore may be tubeless, meaning that the tubular line does not extend through the through-bore of the first element.

Also, the well tubular metal structure may have an axial extension, and the first element may have a length along the axial extension being at least 2 cm.

Moreover, the well tubular metal structure may have an axial extension, and the first element may have a length along the axial extension being at least 2 cm, and preferably at least 5 cm.

Further, the length of the first element may be at least 5 metres, preferably at least 10 metres, and more preferably more than 10 metres.

Additionally, the first element of the downhole closure unit may comprise a post-transition metal.

Also, the first element of the downhole closure unit may comprise a material expanding upon solidification.

Furthermore, the first element of the downhole closure unit may comprise a material liquifying at above 130 degrees centigrade.

Additionally, the first element of the downhole closure unit may comprise a flange at the second opening.

Also, the first element of the downhole closure unit may comprise a flange at the second opening forming a skirt upon solidification.

Furthermore, the first element of the downhole closure unit may be made of/comprise a post-transition metal such as bismuth.

In addition, the first element of the downhole closure unit may be made of a low-melt-point alloy and/or a eutectic alloy.

Moreover, the first element of the downhole closure unit may be made of/comprise a low-melt-point alloy such as a bismuth tin (Bi/Sn) alloy and may be a eutectic alloy. The alloy may be a 58/42 bismuth tin (Bi/Sn) alloy, which melts/freezes at 138 degrees centigrade. An alloy will be denser than the fluid filling the well, typically water or brine, and will therefore displace the ambient well fluid in the fluid communication, facilitating the creation of a secure and fluid-tight bond and closure of the fluid communication when activated. The relatively high density of the alloy will also result in a flowable or mouldable alloy behaving in a relatively predictable manner. Alloys may be selected for high mobility such that the mouldable or flowable alloy may flow into and occupy the through-bore. The solidified alloys may thus be effective in sealing the fluid communication and may also securely engage the cement when cement is arranged around the first element to provide the plug for plug and abandonment. Alloys may be selected to be compatible with the other elements of the downhole closure unit and the bore wall material, and to be compatible with the conditions in the bore, e.g. relatively high ambient bore temperatures or the presence of corrosive materials, such as hydrogen sulphide and carbon dioxide, which might degrade or otherwise adversely affect other materials. Alternatively, or in addition, the first element may comprise a thermoplastic or some other material or blend of materials. In its hardened state, the material of the first element may comprise an amorphous solid.

Further, the first element of the downhole closure unit may comprise at least a first material and a second material, the first material being a post-transition metal, such as bismuth or a bismuth alloy, and the second material being a non-post-transition metal having a higher melting point than the first material.

Additionally, the first element of the downhole closure unit may comprise at least a first material and a second material, the first material comprising a eutectic alloy, such as a bismuth alloy, and the second material being a non-post-transition metal having a higher melting point than the first material.

Also, the second material may be formed as a mesh near a second element end comprising the second opening.

Furthermore, the second material may be formed as a mesh in the lower part to form a skirt around which the bismuth solidifies.

In addition, the downhole closure unit may further comprise a heating element.

Moreover, the downhole closure unit may further comprise a power source such as a battery.

Further, the downhole closure unit may fluidly connect a first part of a tubular line and a second part of the tubular line.

Additionally, the downhole closure unit may be arranged in the annular space.

Furthermore, the downhole expandable tubular may be an expandable metal sleeve.

Also, each end of the expandable metal sleeve may be connected to the tubular metal part by means of first and second connection parts.

Furthermore, the first part of the tubular line may penetrate a first connection part connecting one end of the expandable metal sleeve and the tubular metal part, and/or the second part of the tubular line may penetrate a second connection part connecting one end of the expandable metal sleeve and the tubular metal part.

Additionally, the downhole closure unit, the first part and the second part of the tubular line may fluidly connect the first zone and the second zone.

Also, the downhole annular barrier may comprise a valve unit for controlling the flow of fluid from within the tubular metal part into the annular space for expanding the expandable metal sleeve. The valve unit may also comprise a pressure-equalising function in which the annular space is pressure-equalised with the higher of the pressure in the first zone and the second zone.

Furthermore, the fluid communication in the first element may comprise a fuel part of a thermite material.

In addition, the wall of the through-bore may be at least partly made of thermite.

Moreover, the battery may power an igniter for making a spark to ignite the thermite material for heating the first element.

Further, the tubular line may comprise a hydraulic fluid or an electric conductor.

Additionally, the invention also relates to a method of permanently closing fluid communication in the downhole closure unit for permanently sealing off a control line prior to plug and abandonment of a well, comprising:

inserting a well tubular metal structure having a completion component and an annular barrier comprising the downhole closure unit and a control line in a tubular line for operating the completion component, heating the first element of the downhole closure unit in the annular space of the annular barrier so that the material of the first element at least partly changes condition to a more liquified or mouldable condition, and expanding the material of the first element during solidification of the material of the first element and thus closing the fluid communication between the first opening and the second opening.

Also, heating may be performed by activating a heating element in the first element or in a wireline tool arranged in abutment to the first element.

Furthermore, heating may be performed by pumping an activation fluid down the tubular line.

In addition, the activation fluid may be a chemical creating an exothermal process in the first element.

Moreover, the activation fluid may comprise aluminium metal oxide, e.g. particles of aluminium metal oxide.

Further, the method may also comprise separating a first part of the well tubular metal structure from a second part of the well tubular metal structure at a position opposite the first element before heating of the first element.

Additionally, the method may further comprise pulling the first part of the well tubular metal structure out of the well, setting a plug in the second part of the well tubular metal structure and arranging cement on top of the plug and the downhole closure unit.

Also, after heating the first element the method may further comprise separating the first part of the tubular line from the second part of the tubular line as the first element changes state.

Furthermore, the separation may be performed by means of a wireline tool having a cutting tool and an anchoring section.

In addition, the wireline tool may comprise a stroking tool.

Moreover, the wireline tool may have a driving unit, such as a self-propelling unit for propelling the wireline tool forward in the well.

Finally, the method may further comprise pulling the first part of the well tubular metal structure out of the well and inserting a second first part of the well tubular metal structure instead of the pulled first part of the well tubular metal structure.

Figure 2C:
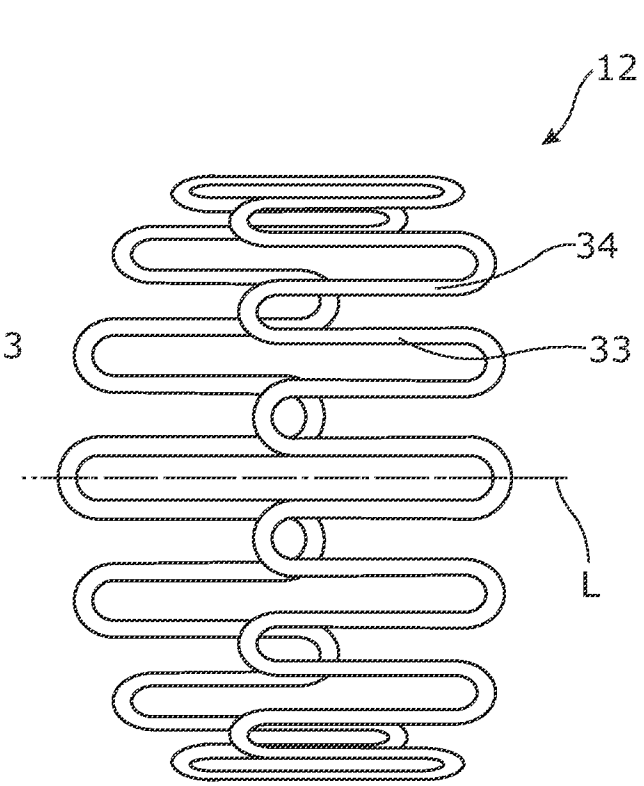
Figure 2B:
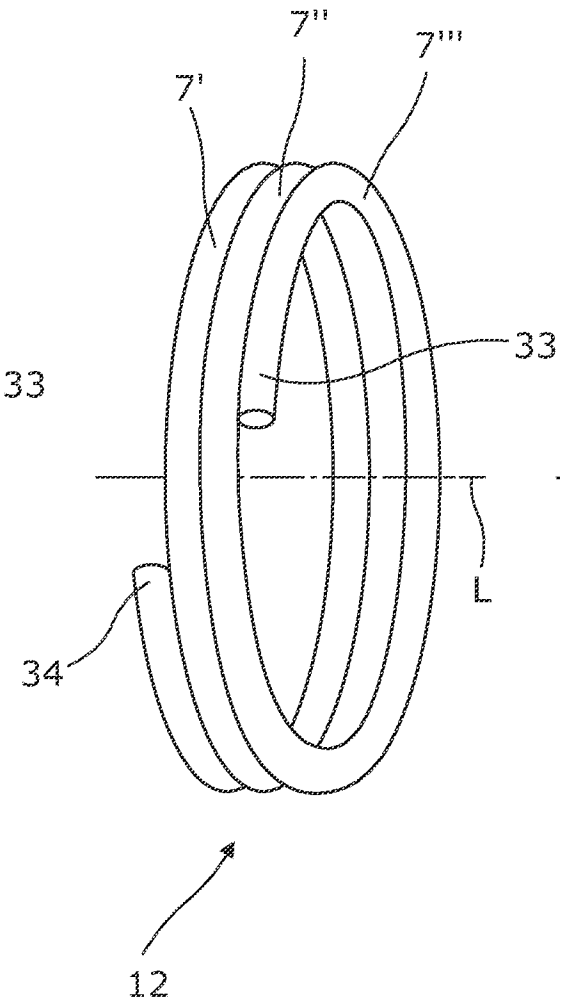
Figure 2A:
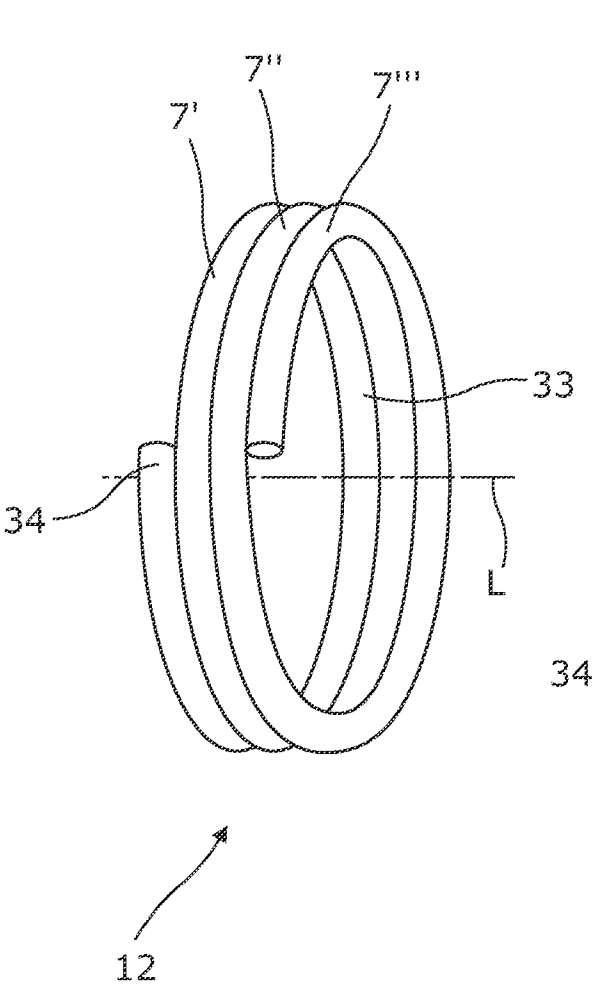
Figure 3:
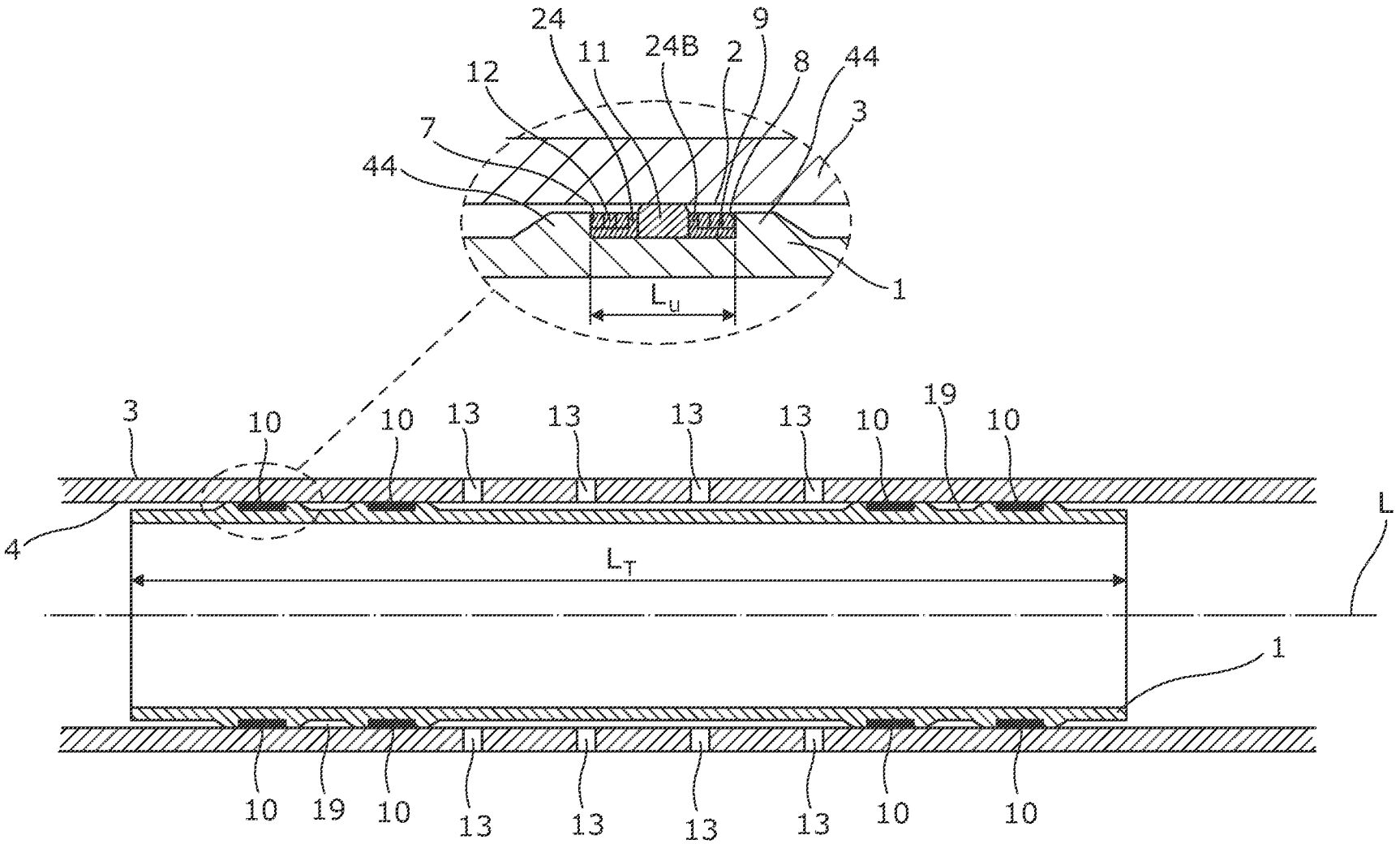
Figure 4:
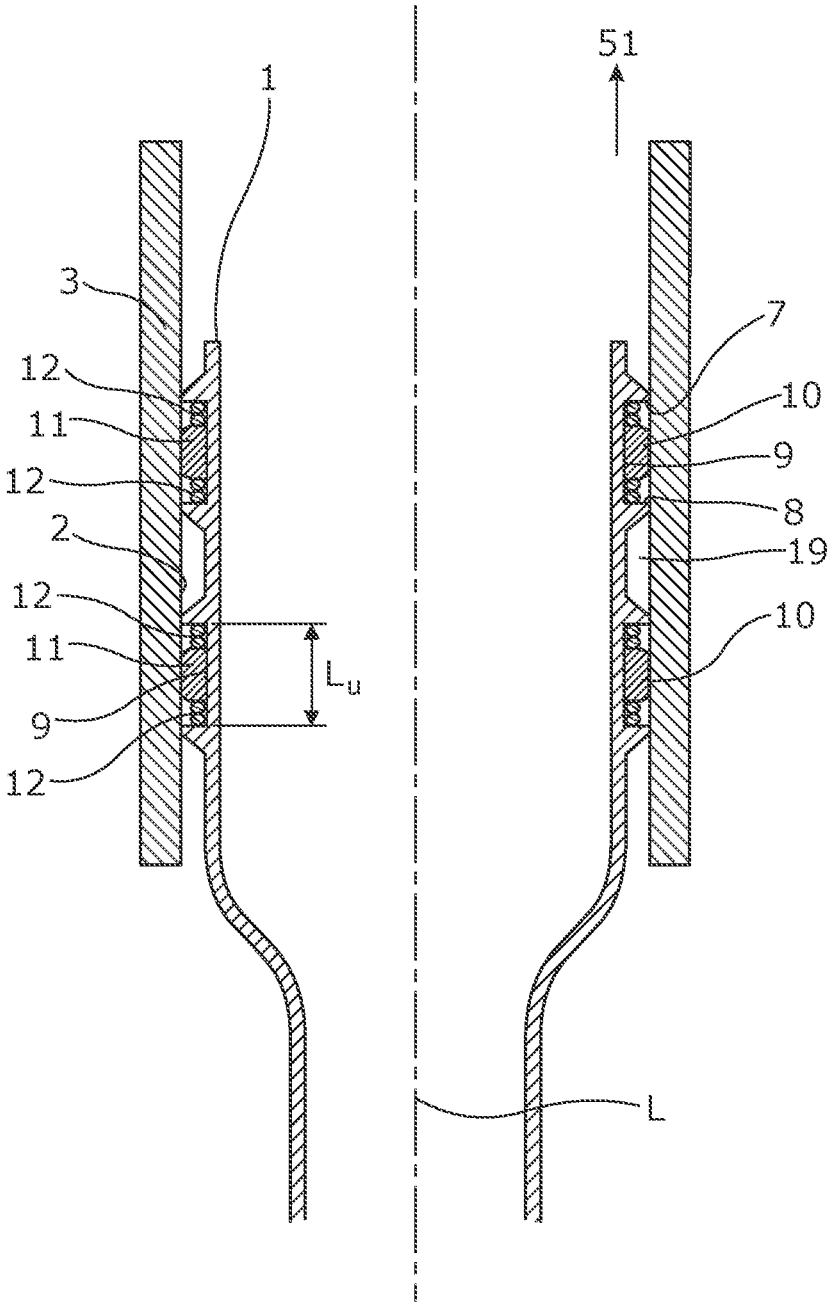
Figure 5:
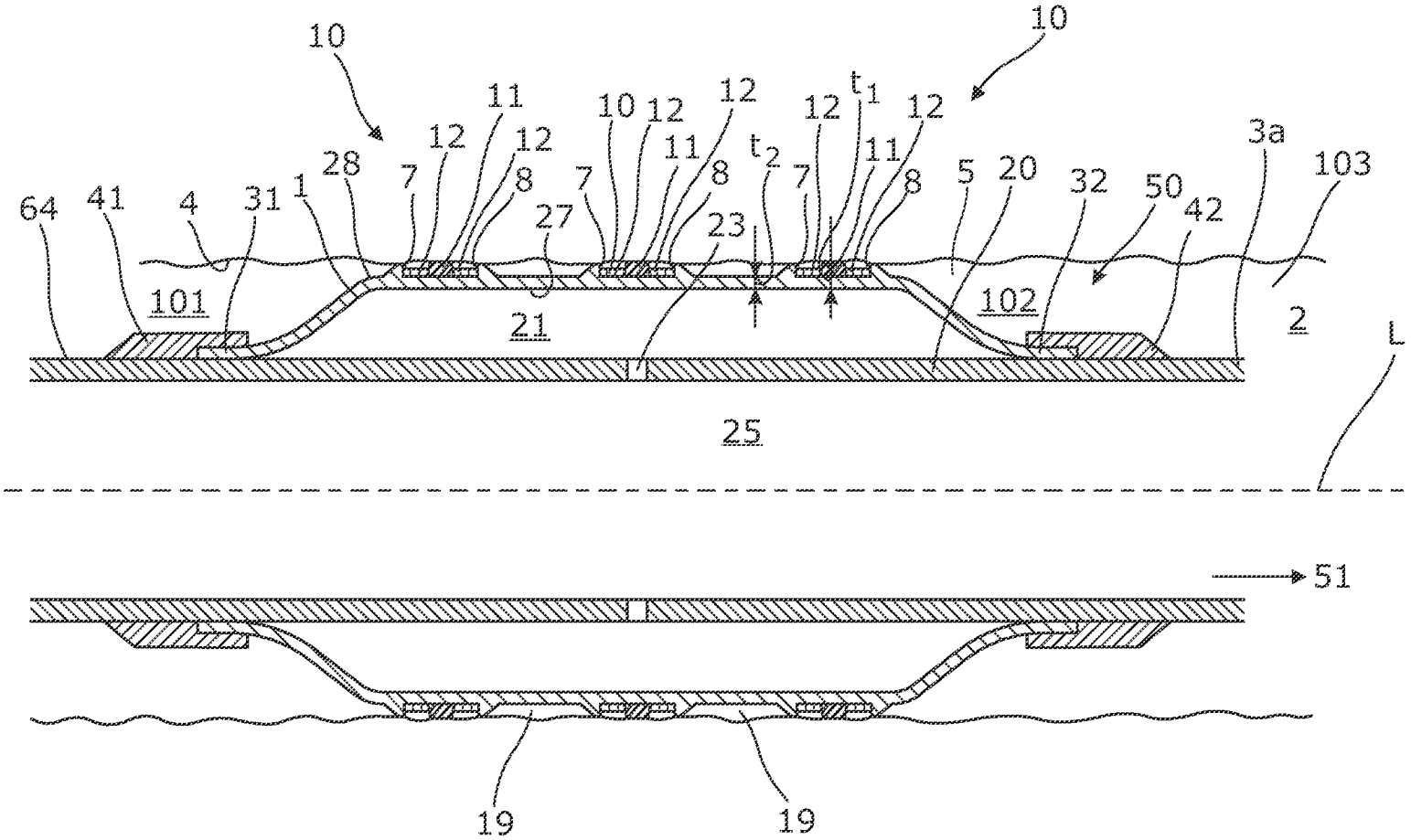
Figure 6:
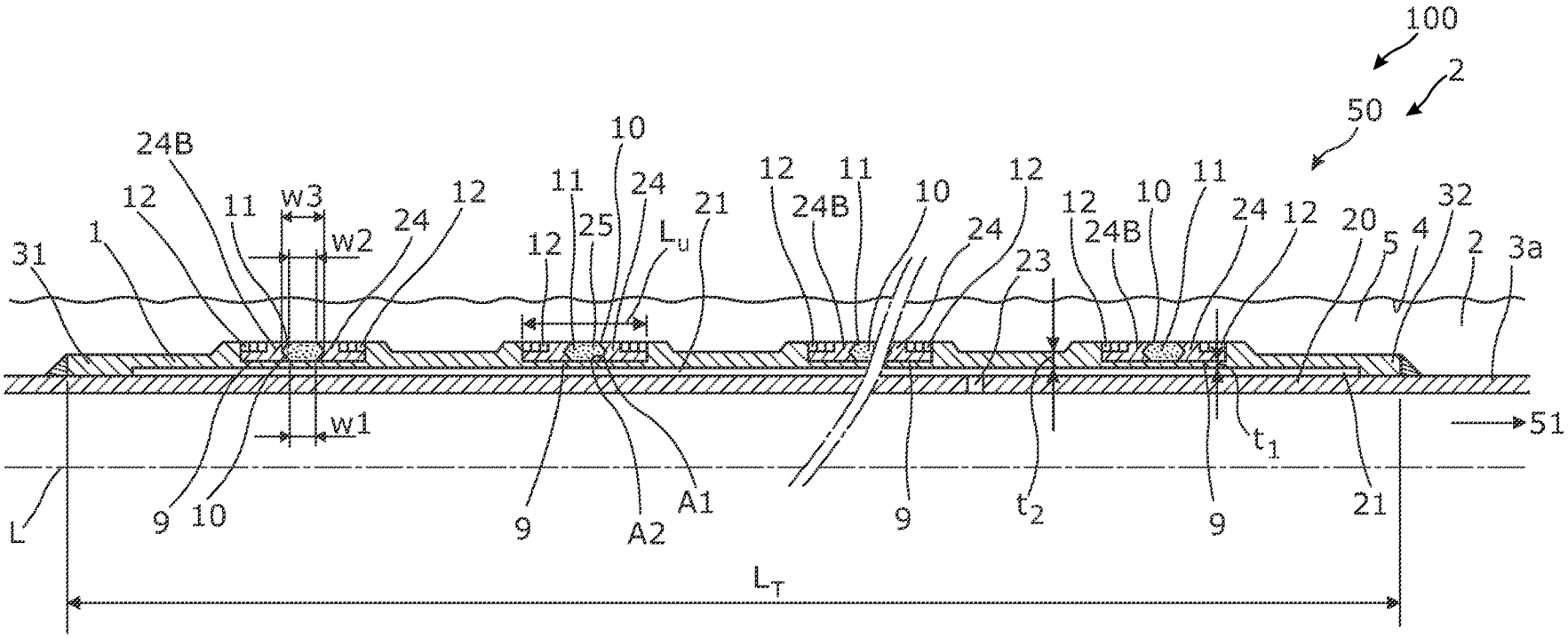
Figure 7:
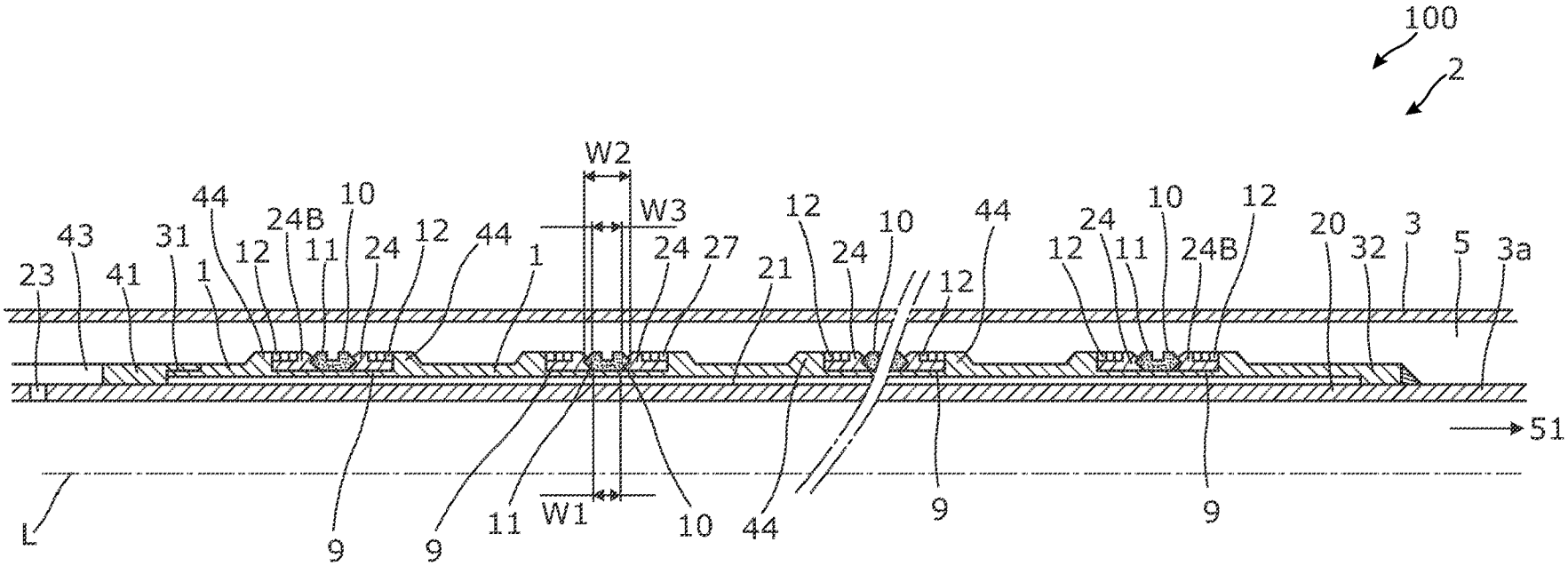
Figure 8:
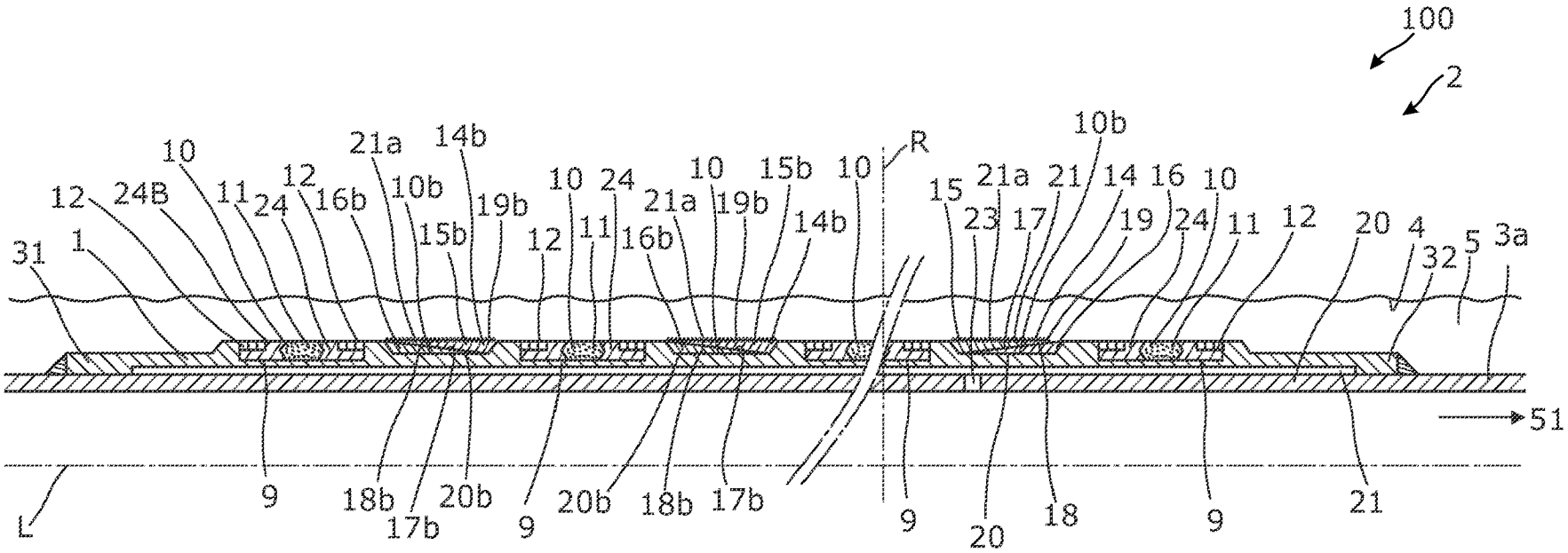
Figure 9A:
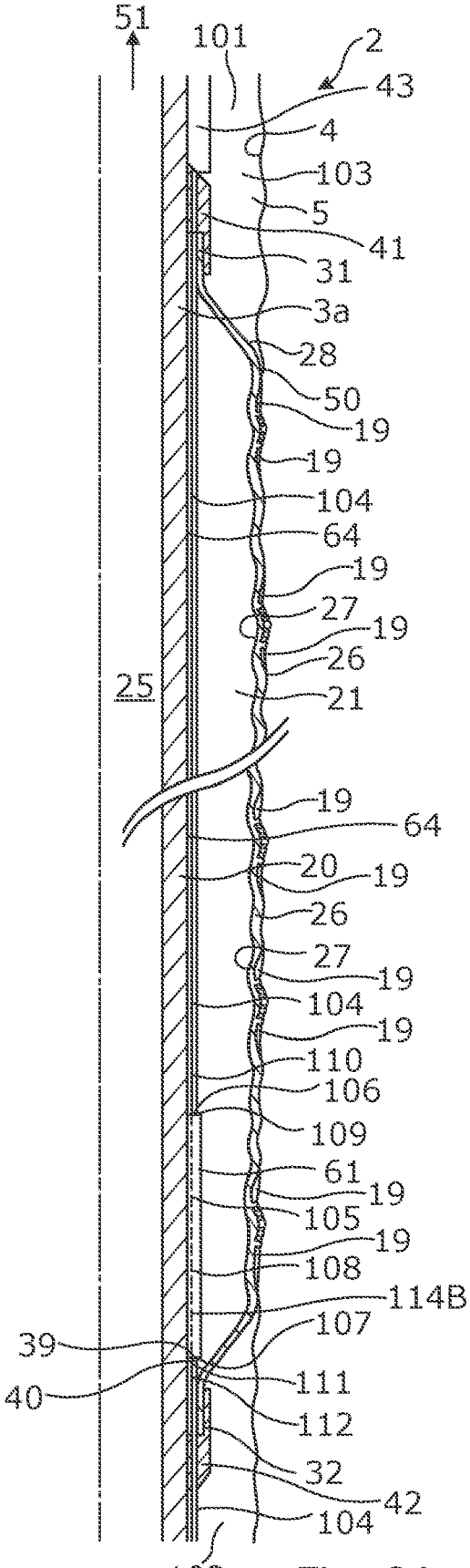
Figure 9B:
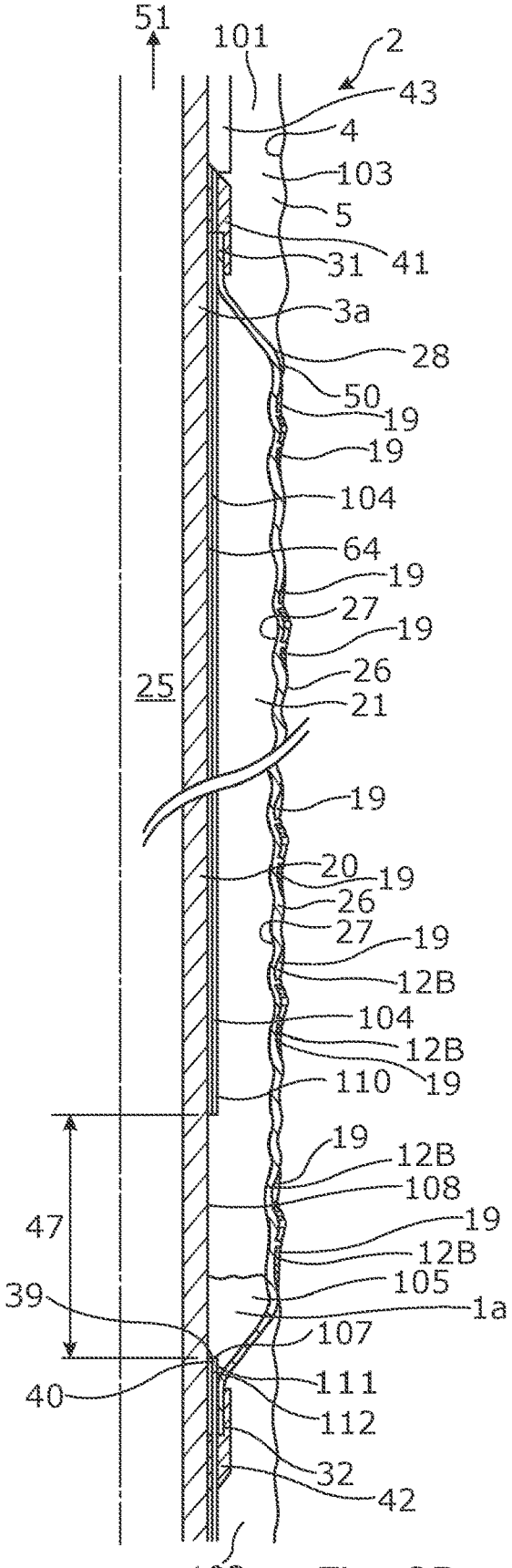
Figure 10:
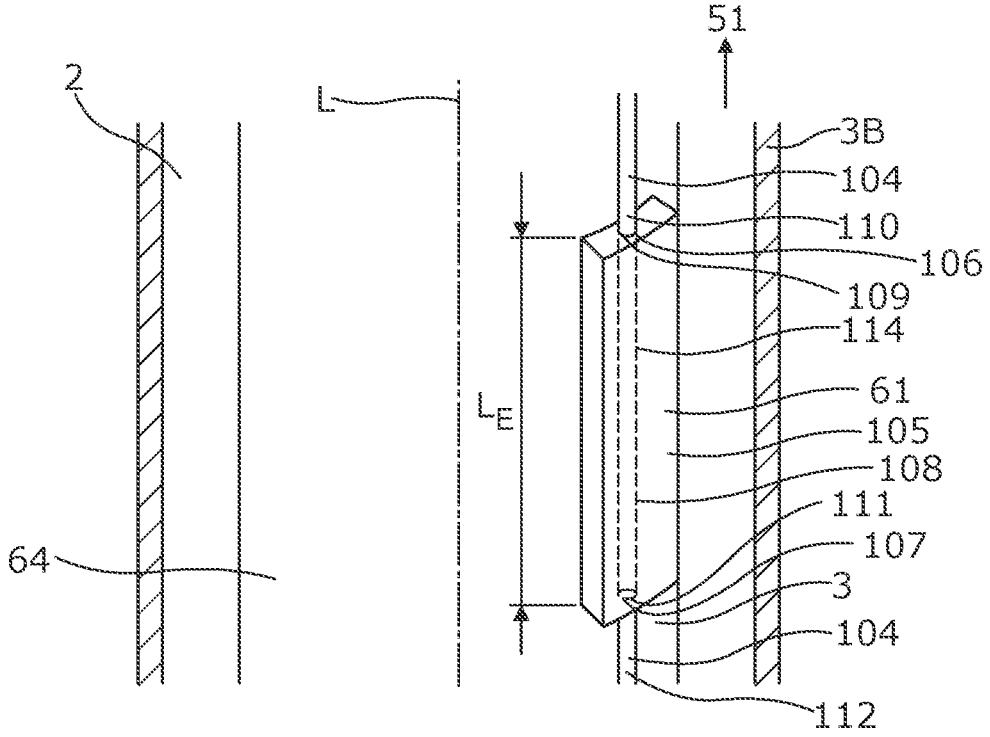
Figure 11:
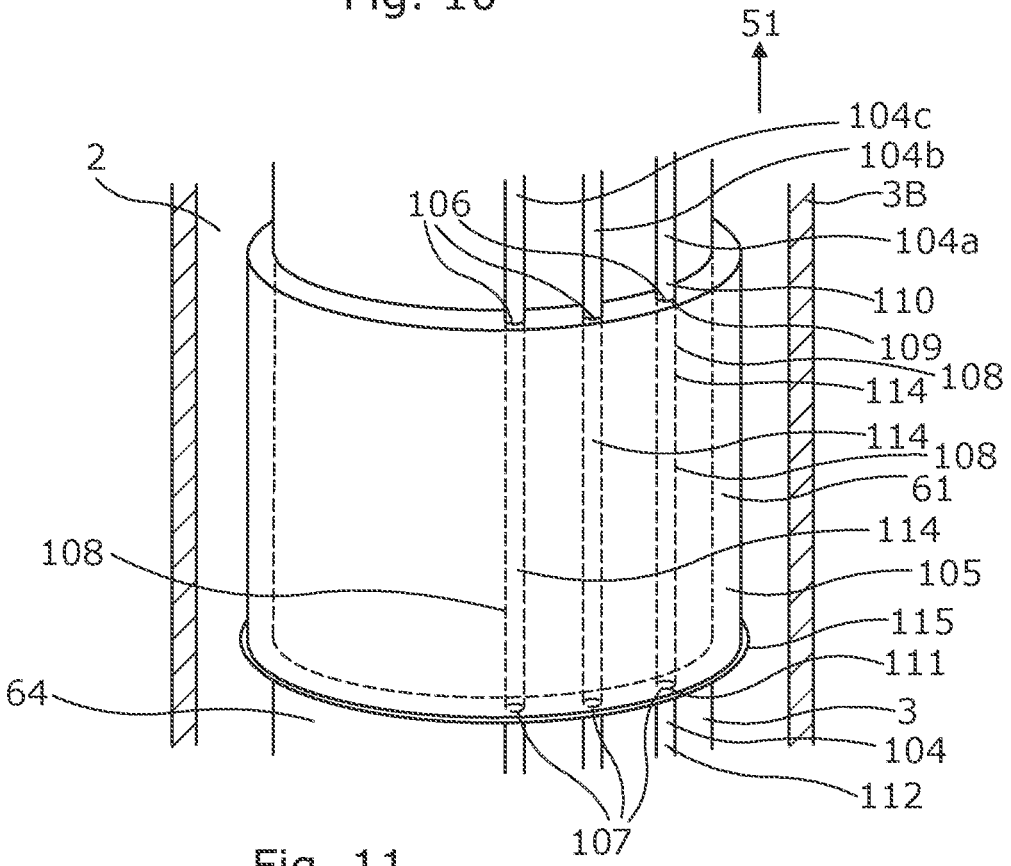
Figure 12:
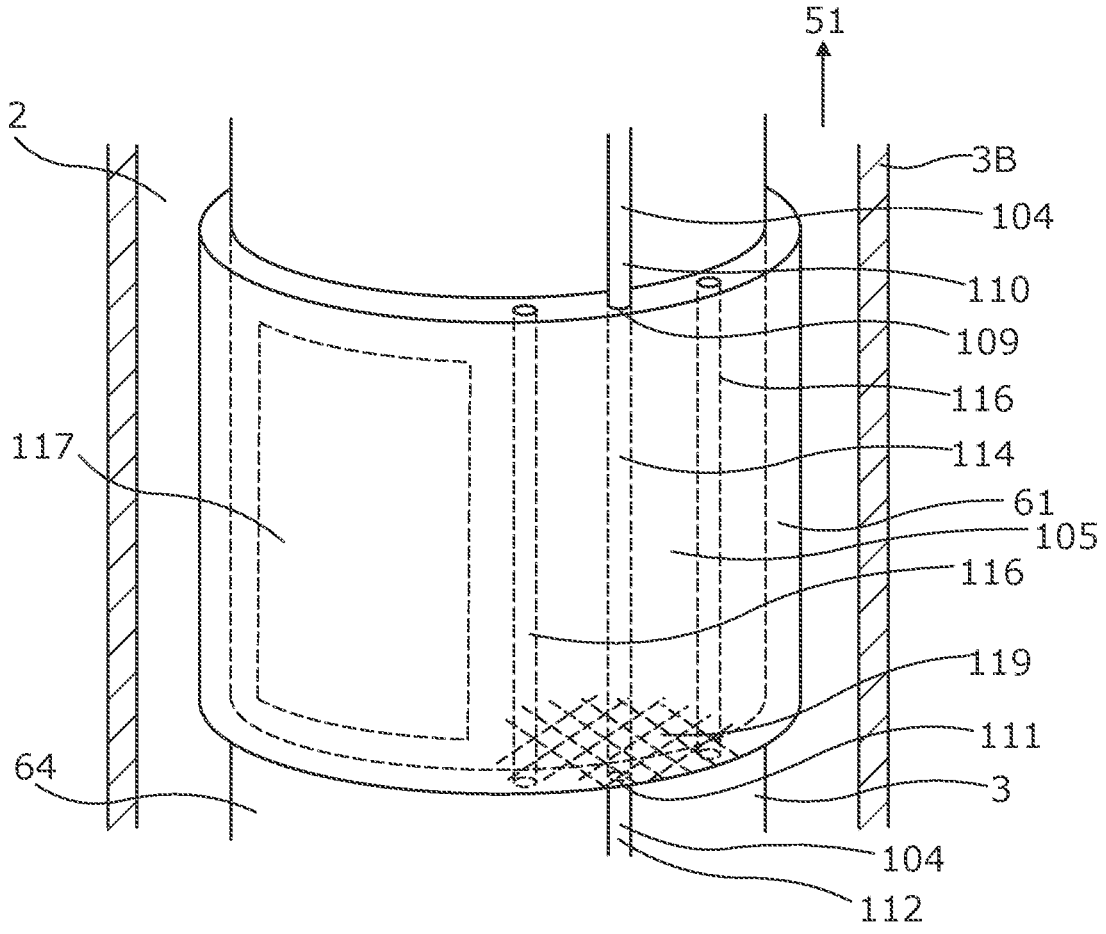
Figure 13:
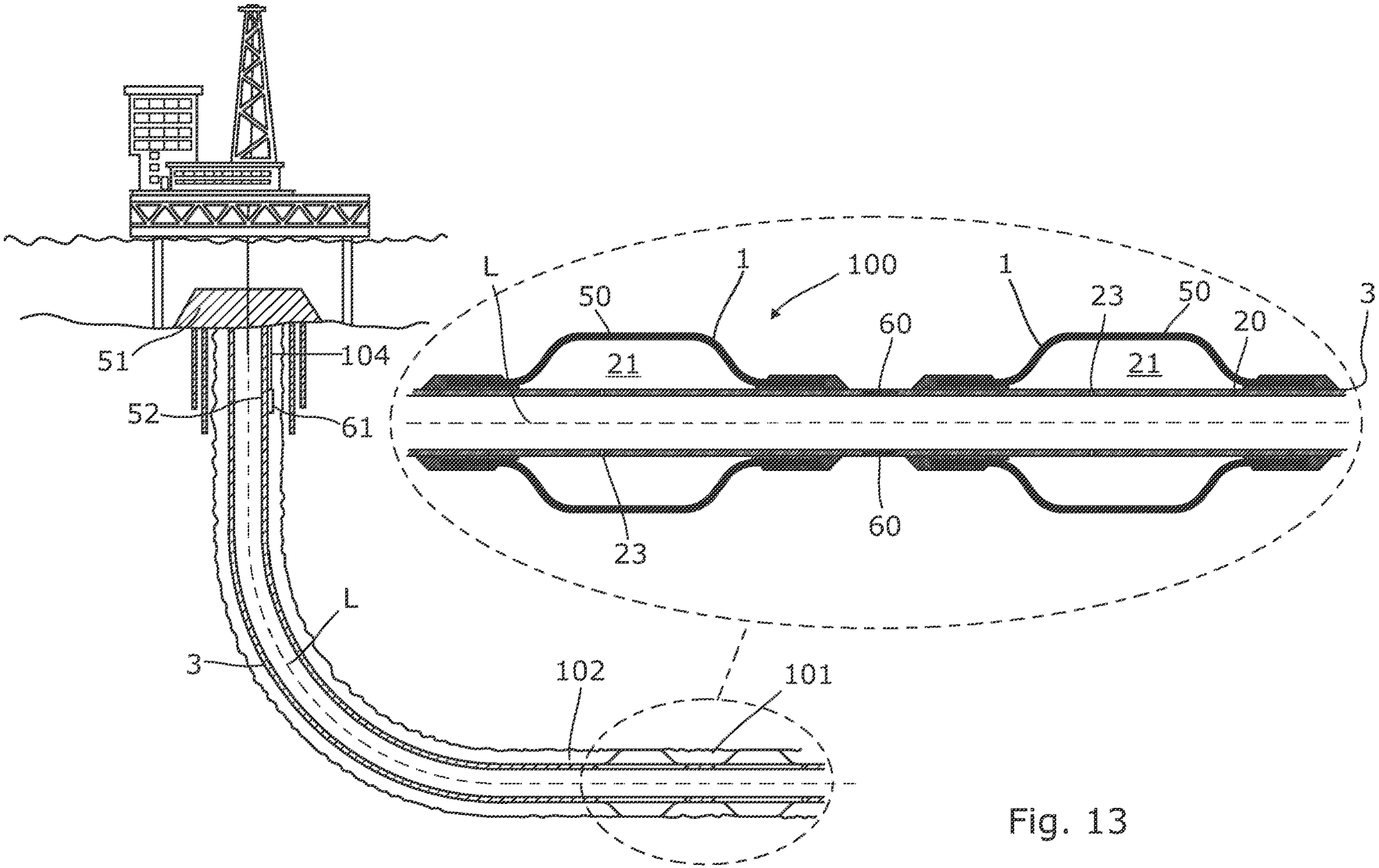
Figure 14:
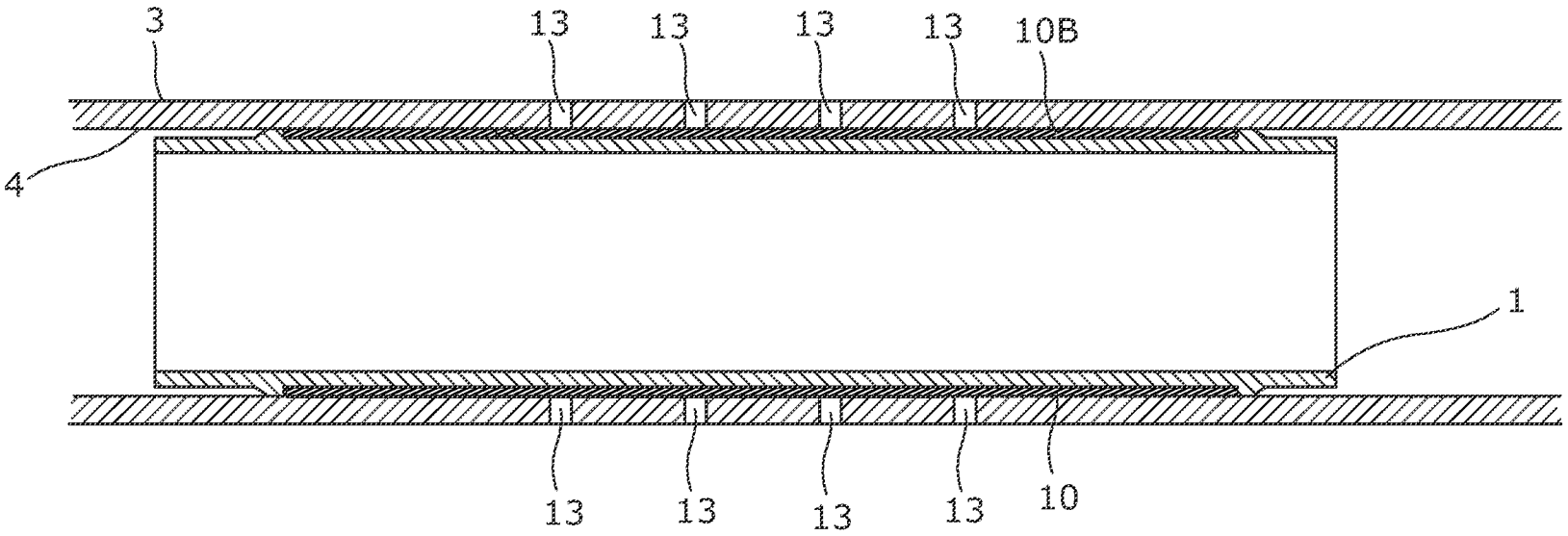
Figure 15:
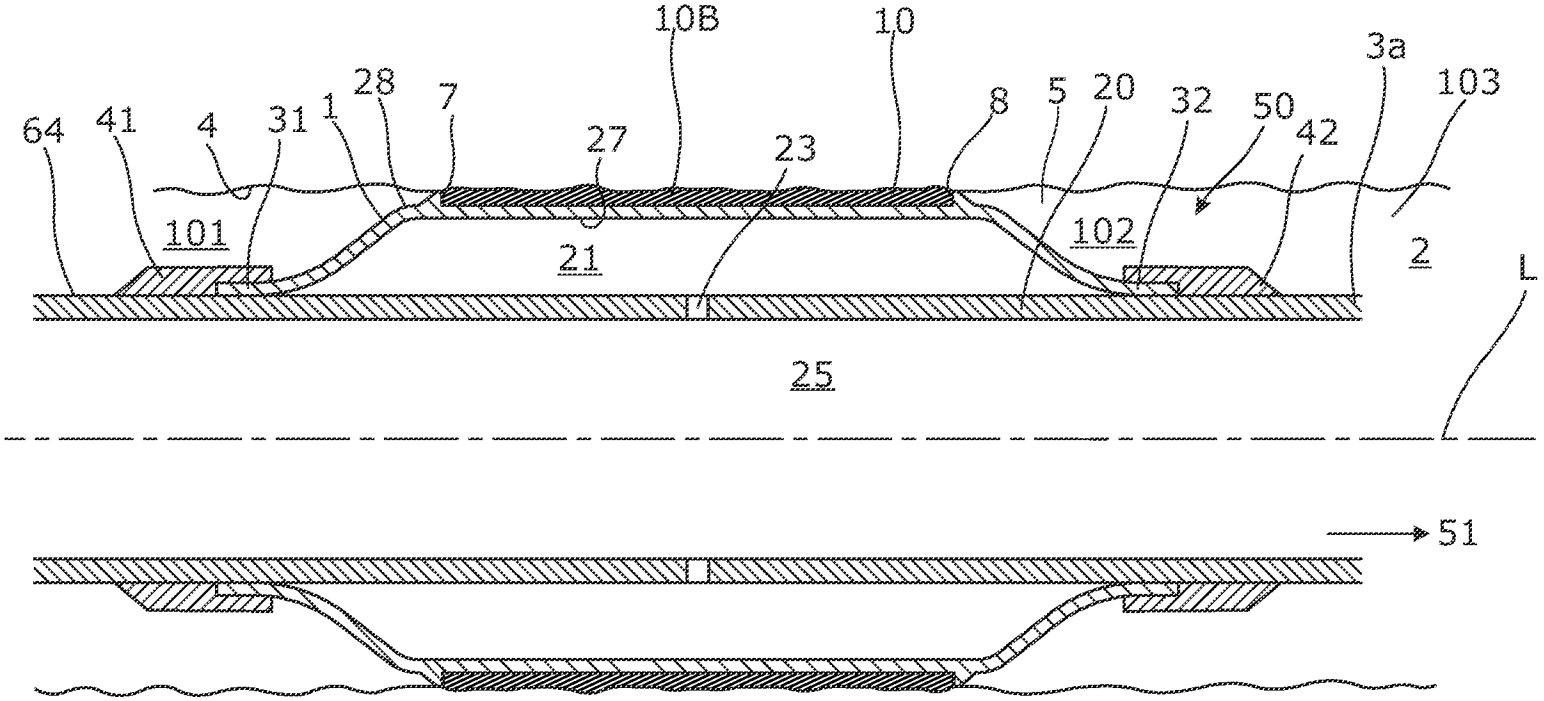

The invention and its many advantages will be described in more detail below with reference to the accompanying schematic drawings, which for the purpose of illustration show some non-limiting embodiments and in which:

FIG. 1 shows a cross-sectional view of part of a downhole expandable tubular in an unexpanded condition to the left and in an expanded condition to the right, FIG. 2*a* shows a retaining element as a split ring-shaped retaining element in an unexpanded condition, FIG. 2*b* shows the retaining element of FIG. 2*a* in an expanded condition being partly unwound, FIG. 2*c* shows another retaining element in an unexpanded condition, FIG. 3 shows a cross-sectional view of a downhole expandable tubular as a straddle being expanded and straddling over a perforated zone, FIG. 4 shows a cross-sectional view of a downhole expandable tubular as a liner hanger being expanded in a top part of the liner hanger, FIG. 5 shows a cross-sectional view of an annular barrier comprising a downhole expandable tubular as an expandable metal sleeve expanded to seal against an inner face of a borehole, FIG. 6 shows a cross-sectional view of another annular barrier comprising a downhole expandable tubular in an unexpanded condition in a borehole, FIG. 7 shows a cross-sectional view of yet another annular barrier comprising a downhole expandable tubular in an unexpanded condition in another well tubular metal structure, FIG. 8 shows a cross-sectional view of yet another annular barrier having anchoring elements, FIG. 9A shows a cross-sectional view of another annular barrier having a downhole closure unit, FIG. 9B shows a cross-sectional view of the annular barrier of FIG. 9A in which the first element of the downhole closure unit has relocated to close a second part of a tubular line penetrating the annular space of the annular barrier, FIG. 10 shows a partly cross-sectional view of a well having a well tubular metal structure and a downhole closure unit connecting a first part of a control line and a second part of a control line, FIG. 11 shows a partly cross-sectional view of a well having another downhole closure unit connecting three control lines, FIG. 12 shows a partly cross-sectional view of a well having yet another downhole closure unit, FIG. 13 shows a downhole system having several annular barriers, FIG. 14 shows a cross-sectional view of another downhole expandable tubular as a patch having one sealing unit comprising a post-transition metal material, and FIG. 15 shows a cross-sectional view of another annular barrier comprising a downhole expandable tubular as an expandable metal sleeve expanded to seal against an inner face of a borehole and having one sealing unit comprising a post-transition metal material.

All the figures are highly schematic and not necessarily to scale, and they show only those parts which are necessary in order to elucidate the invention, other parts being omitted or merely suggested.

FIG. 1 shows a downhole expandable tubular 1 for expansion in a well 2 downhole from a first outer diameter $D_1$ to a second outer diameter D2 to abut against an inner face 4 of a well tubular metal structure 3 (shown in FIG. 3, 5 or 7) or borehole 5. The downhole expandable tubular 1 has an outer face 6, a longitudinal extension L and a tubular length LT along the longitudinal extension L. The downhole expandable tubular 1 comprises at least one first circumferential edge 7 and at least one second circumferential edge 8 spaced apart in the longitudinal extension L and provided on the outer face 6, forming a circumferential groove 9. The downhole expandable tubular 1 further comprises a sealing unit 10 arranged in the circumferential groove 9, where the sealing unit 10 has a unit length Lu along the longitudinal extension L being less than 20% of the tubular length LT, and the sealing unit 10 comprises a post-transition metal material.

As can be seen in FIGS. 3-9B, the unit length Lu along the longitudinal extension L may be less than 10% of the tubular length LT, and preferably less than 5% of the tubular length LT.

The post-transition metal material comprises bismuth or a bismuth alloy. The sealing unit 10 comprises more than one element, at least one of the elements comprising the post-transition metal material. The sealing unit 10 comprises several elements in the form of an annular sealing element 11, e.g. made of elastomer or another polymer, and a retaining element 12, and at least the retaining element 12 comprises a post-transition metal material such as bismuth or a bismuth alloy. The element comprising a post-transition metal material such as bismuth or a bismuth alloy is one monolithic whole, as shown in FIGS. 2*a* and 2*b*.

By having the annular sealing element of elastomer or similar material and a retaining element providing back-up for the sealing element, the sealing unit is capable of providing a sufficient sealing ability as known and required in the oil & gas industry while at a later stage the retaining element comprising a post-transition metal material may be able to fill up any gap if needed by heating the retaining element to melt and subsequently solidify at the gap needing to be filled.

In this way, annular barriers ready for plug and abandonment can be incorporated in the seals of the annular barriers so when needed at a later stage can be transformed to proper seal for plug and abandonment.

The material of at least part of the sealing unit 10 expands upon solidification so that the material in a first state is arranged in the circumferential groove 9 and in another condition becomes mouldable or is liquified, moves downwards in the well 2 away from a top 51 and solidifies at a location further down in a second state. In its liquified or mouldable condition, the material decreases in volume as compared to its solid condition and is then able to enter further into cavities and fill out such cavities even more, and upon solidification the material expands, forming a proper seal at the new location. Thus, as a result of heating the material first liquifies or becomes mouldable and then flows into and accumulates in cavities 19 between the downhole expandable tubular 1 and the surrounding wall on which the downhole expandable tubular 1 abuts. Upon solidification, the material expands and provides an excellent seal.

In one embodiment, the material liquifies at above 130 degrees centigrade. The material is made of a low-melt-point alloy such as a bismuth tin (Bi/Sn) alloy and may be a eutectic alloy. The alloy may be a 58/42 bismuth tin (Bi/Sn) alloy, which melts/solidifies at 138 degrees centigrade. An alloy will be denser than the fluid filling the well, typically water or brine, and will therefore displace the ambient well fluid in the fluid communication, facilitating the creation of a secure and fluid-tight bond and closure of the fluid communication when activated. The relatively high density of the alloy will also result in a flowable or mouldable alloy behaving in a relatively predictable manner. Alloys may be selected for high mobility such that the mouldable or flowable alloy may flow into and occupy the through-bore. The solidified alloys may thus be effective in sealing the fluid communication and may also securely engage the cement when cement is arranged around the first element to provide the plug for plug and abandonment. Alloys may be selected to be compatible with the other elements of the downhole closure unit and the bore wall material, and to be compatible with the conditions in the bore, e.g. relatively high ambient bore temperatures or the presence of corrosive materials, such as hydrogen sulphide and carbon dioxide, which might degrade or otherwise adversely affect other materials. Alternatively, or in addition, the material may comprise a thermoplastic or some other material or blend of materials. In its hardened state, the material may comprise an amorphous solid.

The retaining element has a first end 33 and a second end 34, and the first end 33 overlaps the second end 34 when seen along the longitudinal extension L, as shown in FIGS. 2*a* and 2*b*, or along a circumference of the downhole expandable tubular 1, as shown in FIG. 2*c*. In FIG. 2*a*, the retaining element 12 is a split ring-shaped retaining element 12 having more than one winding, so that when the expandable tubular 1 is expanded from the first outer diameter $D_1$ to the second outer diameter D2, the split ring-shaped retaining element 12 partly unwinds as shown in FIG. 2*b*. The split ring-shaped retaining element 12 unwinds by less than one winding when the expandable tubular 1 is expanded from the first outer diameter $D_1$ to the second outer diameter D2, and the split ring-shaped retaining element 12 is thus able to fully support the sealing element 11 even in its expanded condition. The split ring-shaped retaining element 12 has more than one winding in the second outer diameter D2 and the expanded condition of the downhole expandable tubular 1. As shown in FIG. 1, the split ring-shaped retaining element 12 has a width W in the longitudinal extension L, the width W being substantially the same in the first outer diameter $D_1$ and the second outer diameter D2 of the downhole expandable tubular 1. Furthermore, the split ring-shaped retaining element 12 has a plurality of windings 7', 7", 7''', as shown in FIGS. 2*a* and 2*b*. Thus, the ring-shaped retaining element 12 is a split ring.

In FIGS. 1 and 4, the retaining element 12 is arranged in an abutting manner to the sealing element 11 to hold the sealing element 11 in place during the insertion of the downhole expandable tubular 1 and during the expansion of the downhole expandable tubular 1. The retaining element 12 and the sealing element 11 substantially fill a gap created between the first and second circumferential edges 7, 8. The split ring-shaped retaining element 12 retains the sealing element 11 in a position along the longitudinal extension L of the downhole expandable tubular 1 while expanding the split ring-shaped retaining element 12 and the sealing element 11. The first and second circumferential edges 7, 8 are extending in a radial extension in relation to the downhole expandable tubular 1, where the radial extension is perpendicular to the longitudinal extension L of the downhole expandable tubular 1. Upon heating, the material of the retaining elements 12 changes state from a first state as shown in FIGS. 3, 4, 5, 9A to a second state as shown in FIG. 9B in which the material fills a cavity 19 for providing an even tighter seal than before heating. The retaining element 12 thus leaves the circumferential groove 9 and moves down to fill and seal the cavity 19 as shown in FIG. 9B as indicated by the reference number 12B.

The downhole expandable tubular 1 forms part of a straddle as shown in FIG. 3 for straddling over perforations 13 and sealing off these perforations 13 when the downhole expandable tubular 1 is expanded so that the sealing units 10 are pressed against the inner face 4 of the well tubular metal structure 3 on either side of the perforated zone having the perforations 13. The annular sealing unit 10 comprises an annular sealing element 11 and a back-up sealing element 24 abutting and supporting the annular sealing element 11 and the retaining element 12. The downhole expandable tubular 1 has several projections 44, and the circumferential groove 9 is formed between two projections 44. A second back-up sealing element 24, 24B is arranged so that the annular sealing element 11 is between the two back-up sealing elements 24 when seen along the axial extension, and the retaining elements 12 press onto the back-up sealing elements 24, which again press on the sealing element 11. The back-up sealing element 24 is arranged between the split ring-shaped retaining element 12 and the sealing element 11. The split ring-shaped retaining element 12 is thus arranged on a first side of the sealing element 11, and a second split ring-shaped retaining element 12 is arranged on another side of the sealing element 11 opposite the first side.

As shown in FIGS. 3, 4, 5, 9A and 9B, an annular cavity 19 is thus formed between two adjacent sealing units 10. During the liquifying of the material of bismuth or bismuth alloy of part of the sealing unit 10, the material enters into the nearest cavity 19 further down the well, and upon solidification the material expands to provide a very efficient seal, e.g. before the well is plugged and abandoned.

In FIG. 4, the downhole expandable tubular 1 forms part of a liner hanger expanded within a casing or well tubular metal structure 3 in a well, or a casing to be at least partly expanded within another casing.

In FIG. 14, the downhole expandable tubular 1 forms a patch having the sealing unit 10 comprising at least one element 10B, and at least one of the elements comprises the post-transition metal material. The patch is shown in its expanded condition of the downhole expandable tubular abutting the inner face of the casing/well tubular metal structure. In the unexpanded condition of the downhole expandable tubular, the at least one element 10B may be rolled around the outer sleeve face 28 (shown in FIG. 5) having the same "key-ring" shape as the retaining element shown in FIG. 2A or 2C, or the at least one element 10B may in its unexpanded condition of the downhole expandable tubular be one tubular sleeve so that the sealing unit comprises only one element.

FIG. 5 shows a downhole annular barrier 50 to be expanded in an annulus 103 between a well tubular metal structure 3*a* and a wall of the borehole 5 or another well tubular metal structure 3 (as shown in FIG. 7) in a well in order to provide zone isolation between a first zone 101 and a second zone 102 of the borehole 5. The annular barrier 50 comprises a tubular metal part 20 mounted as part of the well tubular metal structure 3*a*, the tubular metal part 20 having an outer face 64 and an inside 25. The downhole annular barrier 50 further comprises the downhole expandable tubular 1 surrounding the tubular metal part 20 and having an inner sleeve face 27 facing the tubular metal part 20 and an outer sleeve face 28 facing the wall of the borehole 5. Each end 31, 32 of the downhole expandable tubular 1 is connected with the tubular metal part 20, defining an annular space 21 between the inner sleeve face 27 of the downhole expandable tubular 1 and the tubular metal part 20. In order to expand the downhole annular barrier 50, fluid is let into an opening 23 from within the well tubular metal structure 3*a*. As shown in FIG. 5, each end 31, 32 of the downhole expandable tubular 1 is connected to the tubular metal part 20 by means of first and second connection parts 41, 42. In FIG. 6, each end 31, 32 of the downhole expandable tubular 1 is connected directly to the tubular metal part 20, e.g. by means of welding, and a combination of one end 31 connected to the tubular metal part 20 by a connection part 41 and the other end 32 directly connected to the tubular metal part is shown in FIG. 7. The sealing units 10 are arranged in grooves of the downhole expandable tubular 1, and the retaining elements 12 are at least partly made of a post-transition metal material such as bismuth or a bismuth alloy. In FIG. 5, the downhole expandable tubular 1 has a first thickness $t_1$ between the first and second circumferential edges 7, 8 and a second thickness $t_2$ in adjacent areas, the first thickness $t_1$ being smaller than the second thickness $t_2$. The sealing unit 10 has an extension radial to the longitudinal extension L of the downhole expandable tubular 1 being less than twice the size of the first thickness $t_1$, and preferably equal to or smaller than the first thickness $t_1$.

FIG. 15 shows another annular barrier 50 in cross-section along the axial extension, where the sealing unit 10 comprises at least one element 10B, and at least one of the elements comprises the post-transition metal material. The annular barrier is shown in its expanded condition of the downhole expandable tubular abutting the inner face of the casing/well tubular metal structure. In the unexpanded condition of the downhole expandable tubular, the at least one element 10B may be rolled around the outer sleeve face 28 having the same "key-ring" shape as the retaining element shown in FIG. 2A or 2C, or the at least one element 10B may in its unexpanded condition of the downhole expandable tubular be one tubular sleeve so that the sealing unit comprises only one element.

FIG. 6 shows another annular barrier 50 in cross-section along the axial extension, where the annular sealing element 11 has a first width W1, a second width W2 and a third width W3, the second width W2 being larger than the first width W1 and the third width W3 and being arranged between the first width W1 and the third width W3. The back-up sealing element 24 has a first contact area A1, and the annular sealing element 11 has a second contact area A2, where the first contact area A1 has a shape that mates with the second contact area A2, as shown in FIG. 6. By having the back-up sealing element 24 with a mating shape as that of the annular sealing element 11 having the second width W2 that is larger than the first width W1 and the third width W3, the back-up sealing element 24 is able to restrict the annular sealing element 11 from opening a potential crack therein.

In FIG. 7, the sealing element 11 has another cross-section with a groove facing towards the well tubular metal structure 3. As shown in FIG. 8, the sealing units 10 are arranged in the circumferential grooves 9, and between these grooves 9 are second circumferential grooves 9*b*, in each of which a circumferential groove 9*b* and an anchoring element 14 are arranged. The anchoring element 14, 14*b* comprises a first anchoring part 15, 15*b* with serrations 21*a* and at least partly overlapping a second anchoring part 16, 16*b* in a radial direction perpendicular to the axial extension so that an inner face 17, 17*b* of the first anchoring part 15, 15*b* at least partly abuts an outer face 18, 18*b* of the second anchoring part 16, 16*b*. In order to provide increased anchoring during axial loading of the annular barrier 50, the inner face 17 of the first anchoring part 15 and the outer face 18 of the second anchoring part 16 are inclined in relation to the axial and longitudinal extension. Thus, when the temperature changes, and at least part of an expandable metal sleeve 26/the downhole expandable tubular 1 moves in one direction along the axial direction, the first anchoring part 15 moves in an opposite direction along the inclined outer face 18 of the second anchoring part 16, and the first anchoring part 15 is then forced radially outwards, anchoring the expandable metal sleeve 26 even further to the other well tubular metal structure 3 or the wall of the borehole 5.

The split ring-shaped retaining element 12 is at least partly made of bismuth or a bismuth alloy and a spring material. The back-up sealing element 24 is preferably made of polytetrafluoroethylene (PTFE) or polymer. The sealing element 11 is preferably made of elastomer, rubber, polytetrafluoroethylene (PTFE) or another polymer.

FIG. 13 shows a downhole system 100 comprising the well tubular metal structure 3 having the inner face 4, the outer face 64, two downhole annular barriers 50, each having the downhole expandable tubular 1, and a downhole closure unit 61 as shown in FIGS. 10-12 arranged on the outer face 64 for permanently sealing off a control line 104 controlling a well component of the well tubular metal structure 3 prior to plug and abandonment of the well 2 having the top 51, the downhole closure unit 61 having a first state in which fluid communication 108 is open to operate a completion component 52 and a second state in which the fluid communication 108 is closed (not shown). The downhole system 100 further comprises a screen 60 for letting production fluid into the well tubular metal structure 3.

FIGS. 9A and 9B show a downhole annular barrier 50 to be expanded in the annulus 103 between the well tubular metal structure 3 and the wall of the borehole 5 or another well tubular metal structure (not shown) in a well in order to provide zone isolation between the first zone 101 and the second zone 102 of the borehole 5. The downhole annular barrier 50 comprises a tubular metal part 20 mounted as part of the well tubular metal structure 3, the tubular metal part 20 having the outer face 64 and the inside 25. The downhole annular barrier 50 further comprises the expandable metal sleeve 26 in the form of the downhole expandable tubular 1 surrounding the tubular metal part 20 and having the inner sleeve face 27 facing the tubular metal part 20 and the outer sleeve face 28 facing the wall of the borehole 5. Each end 31, 32 of the expandable metal sleeve 26 is connected with the tubular metal part 20, defining the annular space 21 between the inner sleeve face 27 of the expandable metal sleeve 26 and the tubular metal part 20. The downhole annular barrier 50 further comprises the downhole closure unit 61 arranged on the outer face 64 in the annular space 21. The downhole closure unit 61 fluidly connects a first part of a tubular/control line 104 and the second part of the tubular line 104. The first part of the tubular line 104 penetrates the first connection part 41 connecting one end of the expandable metal sleeve 26 and the tubular metal part 20, and the second part of the tubular line 104 penetrates the second connection part 42 connecting one end of the expandable metal sleeve 26 and the tubular metal part 20. The downhole closure unit 61, the first part and the second part of the tubular line 104 fluidly connect the first zone 101 and the second zone 102.

The downhole closure unit 61 is shown in more detail in FIGS. 10-12. The downhole closure unit 61 is used for permanently sealing off the control line 104 controlling a well component (not shown) of the well tubular metal structure 3 prior to plug and abandonment of the well 2 having the top 51. The downhole closure unit 61 comprises a first element 105 comprising a first opening 106, a second opening 107 and fluid communication 108 between the first opening 106 and the second opening 107. The first opening 106 is arranged closer to the top 51 than the second opening 107 and at a distance from the second opening 107. The first opening 106 has a first connection 109 and is connected to a first part 110 of the tubular line 104, and the second opening 107 has a second connection 111 and is connected to a second part 112 of the tubular line 104. The first element 105 has a first state in which the fluid communication 108 is open and a second state in which the fluid communication 108 is closed. The first element 105 is shown in its first state where the first part 110 of the tubular line 104 is fluidly connected with the second part 112 of the tubular line 104 through a fluid channel 114 in the first element 105 of the downhole closure unit 61.

The first part of the control line 104 is thus not directly connected to the second part 112 of the tubular line 104 but is connected via the tubular line 104 so that the tubular line 104 does not penetrate the first element 105. The control line 104 is thus formed by the first part 110 of the tubular line 104, the fluid channel 114 in the first element 105 and the second part 112 of the tubular line 104. The fluid communication 108 is provided by a through-bore 114 forming the fluid channel 114 in the first element 105 from the first opening 106 to the second opening 107. Thus, the first element 105 is tubeless, meaning that the tubular line 104 does not extend through the first element 105, nor through the through-bore 114 of the first element 105.

By having a downhole closure unit 61 fluidly connecting the first part 110 of the tubular line 104 with the second part 112 of the tubular line 104, the fluid communication 108 can be closed in a simple manner, and the first part 110 of the tubular line 104 can be pulled out of the well 2 before plugging and abandoning of the well by cement. The downhole closure unit 61 thus provides a very safe way of abandoning a well having a control line for controlling a downhole component.

The fluid communication 108 can be closed in two ways: either by closing the fluid channel 114 providing the fluid communication 108 in the first element 105 of the downhole closure unit 61, or by separating the first part 110 of the tubular line 104 from the second part 112 of the tubular line 104 and sealing off the end of the second part 112 of the tubular line 104. When the fluid channel 114 is closed, the cement surrounds, abuts and seals against the first element 105, and when separation is provided cement surrounds, abuts and seals an outer face 64 of the well tubular metal structure 3 directly as the first element 105 has been displaced downwards, creating access to the outer face 64 of the well tubular metal structure 3 all around the circumference of the well tubular metal structure 3. In either way, the cement does not surround the tubular line/control line 104, and the risk of the well leaking along the tubular line/control line 104 is not present.

The first element 105 as shown in FIG. 9A changes state when the first element 105 is heated above a pre-set temperature at which the first element 105 becomes mouldable or is liquified so that the first element 105 disconnects from the first part 110 of the tubular line 104 and accumulates (illustrated by 1*a*) around and above the second part 112 of the tubular line 104, as shown in FIG. 9B, so as to seal off the second part 112 of the tubular line 104 from the first part 110 of the tubular line 104.

As can be seen in FIG. 10, the well tubular metal structure 3 has an axial extension, and the first element 105 has a length LE along the axial extension being at least 2 cm, and preferably at least 5 cm. The first element 105 comprises a post-transition metal material, such as bismuth, so that the first element 105 comprises a material expanding upon solidification to abut the surrounding other well tubular metal structure 3B. The first element 105 may be made of a low-melt-point alloy, such as a material liquifying at above 130 degrees centigrade, and/or a eutectic alloy.

The first element 105 may comprise a low-melt-point alloy such as a bismuth tin (Bi/Sn) alloy and may be a eutectic alloy. The alloy may be a 58/42 bismuth tin (Bi/Sn) alloy, which melts/freezes at 138 degrees centigrade.

In FIG. 9A, the material of the first element 105 is in its first state, providing fluid communication 108 between the first part 110 and the second part 112 of the tubular line 104. In FIG. 9B, the first element 105 has liquified and subsequently solidified around the second part 112 of the tubular line 104, (illustrated by 1*a*) thereby sealing off an opening 39 in an upper end 40 of the second part 112 of the tubular line 104. Thus, the first element 105 deforms in the lower part of the annular space 21, sealing off the second part 112 of the tubular line 104 in the annular space 21.

Thus, by having the downhole closure unit 61 arranged in the annular space 21 of the annular barrier 50 a very simple way of fluidly disconnecting the tubular line 104 passing therethrough is provided, and the annular barrier 50 can therefore form part of plug and abandonment of the well as no leaks can occur across the annular barrier 50 when the first element 105 has changed from the first state to the second state.

The downhole annular barrier 50 further comprises a valve unit 43 for controlling the flow of fluid from within the tubular metal part 20 into the annular space 21 for expanding the expandable metal sleeve 26, as shown in FIGS. 9A and 9B. The valve unit 43 further comprises a pressure-equalising function in which the annular space 21 is pressure-equalised with the higher of the pressure in the first zone 101 and the second zone 102.

In order to mould or liquify at least part of the first element 105, the fluid communication 108 in the first element 105 may comprise at least a fuel part of a thermite material. The wall of the through-bore 114 creating the fluid communication 108 between the first part 110 and the second part 112 of the tubular line 104 is at least partly made of thermite or covered by thermite, being a pyrotechnic composition of metal powder and metal oxide.

Instead of a heating element 116, the heating may be performed by pumping an activation fluid down the tubular line 104. The activation fluid is a chemical creating an exothermal process in the first element 105, or the activation fluid comprises aluminium metal oxide, e.g. particles of aluminium metal oxide. Oxidizers may include bismuth(III) oxide, boron(III) oxide, silicon(IV) oxide, chromium(III) oxide, manganese(IV) oxide, iron(III) oxide, iron(II,III) oxide, copper(II) oxide or lead(II,IV) oxide. The fuel part in the first element 105 may include aluminium, magnesium, titanium, zinc, silicon or boron. The downhole closure unit 61 may also comprise a battery powering an igniter for making a spark to ignite the thermite material for heating the first element 105.

By having a downhole closure unit 61 fluidly connecting the first part 110 and the second part 112 of the tubular line 104, a very simple way of fluidly disconnecting the tubular line 104 passing therethrough is provided, and the well can therefore easily proceed to the subsequent steps of plug and abandonment of the well as no leaks can occur along the control line 104 when the first element 105 has changed from the first state to the second state. The fluid communication 108 can be closed in a simple manner, and the first part 110 of the tubular line/control line 104 can be pulled out of the well before plugging and abandoning of the well by cement.

As shown in FIG. 9B, a distance 47 is created between the first part 110 and the second part 112 of the tubular line 104 in the second state.

In FIG. 11, the downhole closure unit 61 comprises a flange 115 at the second opening 107. When the first element 105 is heated and thus enters into a mouldable or liquified condition, the flange 115 forms a skirt upon solidification so that the first element 105 solidifies around the flange 115 and thus above the second part 112 of the tubular line 104. By having the flange 115, the solidification is controlled to occur at the position around the flange 115 and the second part 112 of the tubular line 104 to seal off the end of the second part 112 closest to the first part 110. The first part 110 of the tubular line 104 remains open after the first element 105 has changed from the first state to the second state in which the fluid communication 108 is closed. As shown in FIG. 12, the downhole closure unit 61 comprises a mesh 119 in the lower part of the first element 105 to form a skirt around which the material of the first element 105, such as bismuth or a low-melt-point alloy, solidifies.

The downhole closure unit 61 may comprise one fluid communication 108 as shown in FIG. 10 for providing one fluid communication 108 of the control line 104. In FIG. 11, the downhole closure unit 61 comprises three fluid communications 108 in the form of three fluid channels 114, and thus fluid is connecting the first part 110 and the second part 112 of three tubular lines 104, 104*a*, 104*b*, 104*c*. The tubular lines 104, 104*a*, 104*b*, 104*c* may be used for hydraulic communication or electric communication and thus carry hydraulic fluid or an electric conductor/line. Accordingly, the downhole closure unit 61 may comprise a plurality of fluid communications 108 fluidly connecting the first and second parts 110, 112 of a plurality of the tubular lines 104, 104*a*, 104*b*, 104*c*.

In order to heat the first element 105, the downhole closure unit 61 may comprise the heating element 116 and a power source 117, such as a battery, as shown in FIG. 12. The heating element 116 is arranged in two through-bores 114 in the first element 105 on either side of the fluid channel 114 connecting the first part 110 and the second part 112 of the tubular line 104. By heating locally, the material of the first element 105 first becomes mouldable or liquified and then expands during solidification, closing the fluid communication 108 between the first part 110 and the second part 112 of the tubular line 104. Thus, the first element 105 merely changes form locally to fill the fluid channel 114 and thus close the fluid communication 108. The remaining part of the first element 105 remains unchanged even though the first element 105 changes state from the first state to the second state. The mouldable or liquified part of the material of the first element 105 solidifies around the mesh 119 and fills up at least the lower part of the fluid channel 114 nearest the second part 112 of the tubular line 104. The heating element 116 may thus be arranged in the upper part of the downhole closure unit 61 nearest the first part 110 of the tubular line 104, and the mouldable or liquified part of the first element 105 solidifies when flowing down into the lower part of the fluid channel 114.

The downhole closure unit 61 may be heated from within the well tubular metal structure 3 by a wireline tool having the heating element 116. The downhole closure unit 61 completely surrounds the well tubular metal structure 3 in FIG. 11 and only partly surrounds it in FIG. 10. The downhole closure unit 61 may be clamped onto the well tubular metal structure 3 or welded thereto. The downhole closure unit 61 may also only be fastened to the first part 110 and the second part 112 of the tubular line 104, and thus not to the well tubular metal structure 3.

The fluid communication 108 in the downhole closure unit 61 is permanently closed for permanently sealing off the control line 104 prior to plug and abandonment of the well, comprising inserting the well tubular metal structure 3 having a completion component and the annular barrier comprising the downhole closure unit 61 and the control line 104 in the tubular line 104 for operating the completion component, heating the first element 105 of the downhole closure unit 61 in the annular space 21 of the annular barrier 50 so that the material of the first element 105 at least partly changes condition to a more liquified or mouldable condition, and then expanding the material of the first element 105 during solidification of the material of the first element 105 and thus closing the fluid communication 108 between the first opening 106 and the second opening 107. The heating may be performed by activating the heating element 116 in the first element 105 or in the wireline tool arranged in abutment to the first element 105, or by pumping an activation fluid down the tubular line 104. The activation fluid is a chemical creating an exothermal process in the first element 105 and may comprise aluminium metal oxide, e.g. particles of aluminium metal oxide.

After heating the first element 105, the method may further comprise separating the first part 110 of the tubular line 104 from the second part 112 of the tubular line 104 as the first element 105 changes condition. The separation of the first part of the well tubular metal structure 3 from the second part of the well tubular metal structure 3 occurs at a position opposite the first element 105 before heating of the first element 105. The method further comprises pulling the first part of the well tubular metal structure 3 out of the well, setting a plug in the second part of the well tubular metal structure 3 and arranging cement on top of the plug and the downhole closure unit 61. The separation is performed by means of the wireline tool having a cutting tool and an anchoring section. The wireline tool may comprise a stroking tool and/or a driving unit, such as a self-propelling unit for propelling the wireline tool forward in the well. Instead of plugging and abandoning the well, the first part of the well tubular metal structure 3 may be pulled out of the well, and a second first part of the well tubular metal structure 3 may be inserted instead of the pulled first part of the well tubular metal structure 3.

A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular metal part defining an annular barrier space.

By "casing" or "well tubular metal structure" is meant any kind of pipe, tubing, tubular, liner, string, etc., used downhole in relation to oil or natural gas production.

In the event that the tool is not submergible all the way into the casing, a driving unit, such as a self-propelling unit or a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole expandable tubular for expansion in a well downhole from a first outer diameter to a second outer diameter to abut against an inner face of a well tubular metal structure or borehole, the downhole expandable tubular having an outer face, a longitudinal extension and a tubular length along the longitudinal extension, comprising:

at least one first circumferential edge and at least one second circumferential edge spaced apart in the longitudinal extension and provided on the outer face, forming a circumferential groove, and a sealing unit arranged in the circumferential groove, wherein the sealing unit comprises a post-transition metal material, wherein the sealing unit further comprises an annular sealing element and a retaining element, and at least the retaining element comprises the post-transition metal material, and wherein the annular sealing element is made of elastomer, natural or synthetic rubber, or a polymer, and wherein the retaining element is configured to transition from a production configuration in which the retaining element serves to retain the annular sealing element in place within the groove, and an abandonment configuration in which the retaining element is at least partly melted and exclusively serves to plug and seal the well in preparation for abandonment.

2. A downhole expandable tubular according to claim 1, wherein the post-transition metal material comprises bismuth or a bismuth alloy.

3. A downhole expandable tubular according to claim 1, wherein the sealing unit has a unit length along the longitudinal extension being less than 20% of the tubular length.

4. A downhole expandable tubular according to claim 1, wherein the sealing unit comprises more than one element, and at least one of the elements comprises the post-transition metal material.

5. A downhole expandable tubular according to claim 4, wherein the element comprising a post-transition metal material such as bismuth or a bismuth alloy is one monolithic whole.

6. A downhole expandable tubular according to claim 1, wherein the the annular sealing element and the retaining element are provided in the groove, and the post-transition metal material comprises bismuth or a bismuth alloy.

7. A downhole expandable tubular according to claim 6, wherein the annular sealing element is made of the elastomer.

8. A downhole expandable tubular according to claim 6, wherein the retaining element has a first end and a second end, and the first end overlaps the second end when seen along the longitudinal extension or along a circumference of the downhole expandable tubular.

9. A downhole expandable tubular according to claim 6, wherein the retaining element is a split ring-shaped retaining element having more than one winding, so that when the expandable tubular is expanded from the first outer diameter to the second outer diameter, the split ring-shaped retaining element partly unwinds.

10. A downhole expandable tubular according to claim 9, wherein the split ring-shaped retaining element unwinds by less than one winding when the expandable tubular is expanded from the first outer diameter to the second outer diameter.

11. A downhole expandable tubular according to claim 1, wherein the material expands upon solidification.

12. A downhole expandable tubular according to claim 1, wherein the material liquifies at above 130 degrees centigrade.

13. An annular barrier for expansion in an annulus between a well tubular metal structure and an inner face of a borehole or another well tubular metal structure for providing zone isolation between a first zone and a second zone of the borehole, comprising:

a tubular metal part for mounting as part of the well tubular metal structure, a downhole expandable tubular according to claim 1 surrounding the tubular metal part and having an outer face facing towards the inner face of the borehole or the well tubular metal structure, each end of the downhole expandable tubular being connected with the tubular metal part, an annular space between the downhole expandable tubular and the tubular metal part, and an expansion opening in the tubular metal part through which fluid may enter into the annular space in order to expand the downhole expandable tubular.

14. An annular barrier according to claim 13, further comprising a downhole closure unit in the annular space for permanently sealing off a control line controlling a well component of a well tubular metal structure prior to plug and abandonment of a well having a top, comprising:

a first element comprising a first opening, a second opening and fluid communication between the first opening and the second opening, the first opening being arranged closer to the top than the second opening, the first opening having a first connection to a first part of a tubular line, and the second opening having a second connection to a second part of the tubular line, wherein the first element has a first state in which the fluid communication is open and a second state in which the fluid communication is closed.

15. A downhole system comprising a well tubular metal structure having an inner face, an outer face and an annular barrier according to claim 14.

16. A method of permanently closing fluid communication in the downhole closure unit for permanently sealing off a control line prior to plug and abandonment of a well, comprising:

inserting a well tubular metal structure having a completion component and an annular barrier according to claim 14 comprising the downhole closure unit and a control line in a tubular line for operating the completion component, heating the first element of the downhole closure unit in the annular space of the annular barrier so that the material of the first element at least partly changes condition to a more liquified or mouldable condition, and expanding the material of the first element during solidification of the material of the first element and thus closing the fluid communication between the first opening and the second opening.

17. A downhole system comprising a well tubular metal structure having an inner face, an outer face, a downhole expandable tubular according to claim 1 being connected to the inner face, and a downhole closure unit arranged on the outer face for permanently sealing off a control line controlling a well component of the well tubular metal structure prior to plug and abandonment of a well having a top, the downhole expandable tubular comprising:

a first element comprising a first opening, a second opening and fluid communication between the first opening and the second opening, the first opening being arranged closer to the top than the second opening, the first opening having a first connection to a first part of a tubular line, and the second opening having a second connection to a second part of the tubular line, wherein the first element has a first state in which the fluid communication is open and a second state in which the fluid communication is closed.

18. A method of operating a well, comprising:

inserting the downhole expandable tubular according to claim 1 into the well tubular metal structure or borehole, expanding the annular sealing element and the retaining element so the annular sealing element engages the inner face of the well tubular metal structure or the borehole, while the retaining element secures the annular sealing element in place within the groove, commencing production of the well, when the well is to be abandoned, heating at least the retaining element so that the post-transition metal material of the retaining element at least partly changes condition to a more liquified or mouldable condition, and expanding the post-transition metal material of the retaining element during solidification of the post-transition metal material of the retaining element to plug the well, thus permanently ceasing production and abandoning the well.

19. A downhole expandable tubular according to claim 1, wherein the retaining element engages the annular sealing element within the groove during well production, and is configured to at least partly melt in order to serve as a secondary seal when the well is abandoned, in which event at least part of the retaining element is displaced from the groove and at least partially separates from and disengages the annular sealing element.

20. A downhole expandable tubular for expansion in a well downhole from a first outer diameter to a second outer diameter to abut against an inner face of a well tubular metal structure or borehole, the downhole expandable tubular having an outer face, a longitudinal extension and a tubular length along the longitudinal extension, comprising:

at least one first circumferential edge and at least one second circumferential edge spaced apart in the longitudinal extension and provided on the outer face, forming a circumferential groove, and a sealing unit arranged in the circumferential groove, the sealing unit comprises at least one element comprises a post-transition metal material, wherein the element is arranged within the groove during well production and is configured to at least partly melt in order to serve as a secondary seal when the well is abandoned, in which event at least part of the element is displaced from the groove and at least partially separates from and disengages the groove.

* * * * *